US006899592B1

(12) United States Patent
Kojima et al.

(10) Patent No.: US 6,899,592 B1
(45) Date of Patent: May 31, 2005

(54) POLISHING APPARATUS AND DRESSING METHOD FOR POLISHING TOOL

(75) Inventors: Shunichiro Kojima, Tokyo (JP); Kazuto Hirokawa, Tokyo (JP); Akira Kodera, Kanagawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/636,915

(22) Filed: Aug. 8, 2003

Related U.S. Application Data

(63) Continuation of application No. PCT/JP03/08766, filed on Jul. 10, 2003.

(30) Foreign Application Priority Data

Jul. 12, 2002 (JP) ..... 2002-204498

(51) Int. Cl.[7] ..... B49D 1/00

(52) U.S. Cl. ..... 451/6; 451/36; 451/41; 451/56; 451/60; 451/286; 451/287; 451/288; 451/289; 451/443; 451/444; 451/910

(58) Field of Search ..... 451/36, 41, 56, 451/60, 286, 287, 288, 289, 443, 444, 910

(56) References Cited

U.S. PATENT DOCUMENTS 6,126,523 A * 10/2000 Moriyasu et al. ..... 451/56
6,270,396 B1 * 8/2001 Uchiyama ..... 451/56
6,609,962 B1 * 8/2003 Wakabayashi et al. ..... 451/443
6,672,945 B1 * 1/2004 Matsuo et al. ..... 451/56
2003/0100246 A1 5/2003 Hirokawa et al.

FOREIGN PATENT DOCUMENTS

JP 2002-324771 11/2002

OTHER PUBLICATIONS

Pending U.S. Appl. No. 09/641,347, filed Aug. 18, 2000, in the name of Matsuo et al.

* cited by examiner

*Primary Examiner*—Joseph J. Hall, III
*Assistant Examiner*—Shantese L. McDonald
(74) *Attorney, Agent, or Firm*—Wenderoth, Lind & Ponack, L.L.P.

(57) ABSTRACT

In a polishing apparatus, a polishing tool including abrasive particles and a binder for bonding together the abrasive particles is pressed against a substrate to polish the substrate. The polishing apparatus has a light source for irradiating a polishing surface with light rays for weakening a bond force of the binder for bonding together the abrasive particles, and a waste matter removing mechanism for forcefully removing waste matter produced by polishing or waste matter produced by irradiation. By irradiating the polishing surface with the light rays, dressing of the polishing surface is performed, and products resulting from dressing and the like are removed. The polishing apparatus supplies abrasive particles to the polishing surface stably by dressing and allows high-speed polishing of the substrate.

14 Claims, 12 Drawing Sheets

POLISHING APPARATUS AND DRESSING METHOD FOR POLISHING TOOL

REFERENCE TO RELATED APPLICATION

This is a continuation of International Application PCT/JP03/08766, filed Jul. 10, 2003, the contents of which are incorporated herein by reference. This application further claims priority on Japanese Application 2002-204498, filed Jul. 12, 2002.

TECHNICAL FIELD

The present invention relates to a polishing apparatus having a light source for dressing (regenerating) a polishing tool by irradiation with light rays, and further having a waste matter removing device for removing waste matter (contamination) produced by dressing and the like. The present invention also relates to a dressing method for a polishing tool that has an addressing step (light ray irradiation step) of dressing the polishing tool by irradiation with light rays, and a waste matter removing step of removing waste matter produced by the dressing and the like.

BACKGROUND ART

With rapid progress of technology to fabricate high-integration semiconductor devices in recent years, circuit wiring patterns or interconnections have been becoming increasingly small and fine, and devices fabricated as integrated circuits have also been further downsized. Under these circumstances, there is a need for a process of planarizing a surface of a substrate, e.g. a semiconductor wafer, by polishing away a film formed on a substrate surface. As a manner for this planarization, polishing using a chemical/mechanical polishing (CMP) apparatus has heretofore been performed. This kind of chemical/mechanical polishing (CMP) apparatus has a turntable with a polishing cloth (pad) bonded thereto and a top ring. A substrate to be polished is interposed between the turntable and the top ring. In this state, the top ring and the turntable rotate while the top ring is pressing the substrate against the polishing cloth (pad) on the turntable with a predetermined pressure. In addition, a polishing solution (slurry) is supplied to an area of sliding contact between the substrate and the polishing cloth (pad), thereby polishing a surface of the substrate to a flat and specular surface.

Meanwhile, research has been conducted on a process of polishing semiconductor wafers and the like using a polishing tool including a fixed abrasive, in which abrasive particles, e.g. cerium oxide ($CeO_2$), are fixed together by using a binder, e.g. a phenolic resin. In polishing using such a polishing tool, because a polishing surface of the tool is rigid unlike that used in conventional chemical/mechanical polishing, projections on an uneven surface are preferentially polished away, but depressions are difficult to polish away. Accordingly, it is easy to obtain absolute flatness advantageously. In addition, a self-stop function is available, depending on composition of components of the polishing tool, whereby when projections have been completely polished away to form a flat surface, a polishing rate reduces remarkably, so that polishing will not virtually proceed any longer. Furthermore, because a polishing process employing such a polishing tool does not use a polishing slurry containing a large amount of abrasive particles, a load imposed in terms of environmental issues reduces favorably.

SUMMARY OF THE INVENTION

Generally, in polishing of substrates using a polishing tool (fixed abrasive or bonded abrasive), a surface of the polishing tool is subjected to regeneration (dressing) using a dresser having bonded diamond particles or the like, whereby free abrasive particles useful for polishing substrates and semi-free abrasive particles partially adhering to this polishing surface are generated from the fixed abrasive. However, in a semiconductor wafer polishing process using a polishing tool, the polishing rate reduces gradually although it is high immediately after the polishing tool has been dressed. Thus, the polishing rate is unstable. To stabilize the polishing rate, it is necessary to dress the polishing tool before each polishing operation so that free abrasive particles are sufficiently generated from the fixed abrasive. However, if the polishing tool is dressed before each polishing operation, because a predetermined period of time is required to perform dressing, throughput reduces and productivity degrades in practical application.

Furthermore, a dresser having fixed diamond particles that is employed in general chemical/mechanical polishing involves a problem in that diamond particles may fall off onto a polishing surface. Diamond particles falling off onto the polishing surface may scratch a substrate surface to be polished.

As one manner for solving the above-described problems, a dressing method using light irradiation has been invented. However, an actual polishing surface may be provided with substances (waste matter) unrelated to polishing, such as products resulting mainly from a change in properties of a binder or other substance occurring during irradiation of a polishing tool with light, polishing products generated when a substrate is polished, and inert abrasive particles having undergone a reaction during a polishing process. If such foreign substances are present on a polishing surface, it is difficult to increase a polishing rate and to ensure stability therefor even if free abrasive particles are sufficiently generated from a fixed abrasive.

The present invention was made in view of the above-described circumstances. An object of the present invention is to provide a polishing apparatus for polishing a substrate using a polishing tool including abrasive particles, e.g. diamond particles, and a binder, which performs optical dressing associated with a minimal occurrence of a problem of falling off of diamond particles onto a polishing surface of the polishing tool, and which is capable of stably supplying abrasive particles to the polishing surface of the polishing tool, and also capable of removing waste matter produced by dressing, thereby allowing polishing to be performed on the substrate at a stabilized high polishing rate. Another object of the present invention is to provide a dressing method for a polishing tool including abrasive particles and a binder.

According to a first feature of the present invention, the polishing apparatus includes a polishing tool having a polishing surface including: abrasive particles and a binder for bonding together the abrasive particles; a moving mechanism for pressing a substrate against a polishing surface and causing relative movement between the substrate and the polishing surface to polish the substrate; a light source for irradiating the polishing surface with light rays for weakening a bond force of the binder; and a waste matter removing mechanism for removing waste matter produced by irradiation with the light rays from the polishing surface. The moving mechanism includes: a top ring for holding a substrate; a turntable for supporting the polishing tool; and a motor or the like for rotating the top ring and the turntable or oscillating them according to need. The waste matter removing mechanism forcefully removes from the polishing surface waste matter produced by a polishing process and waste matter produced by the irradiation with the light rays.

The polishing apparatus according to the first feature of the present invention has a light source and a waste matter removing mechanism. Accordingly, it is possible to apply light rays onto the polishing surface of the polishing tool by the light source to weaken the bond force of the binder for bonding together the abrasive particles so that the binder becomes unable to retain the abrasive particles, thereby allowing free abrasive particles to be generated from the fixed abrasive. Further, the waste matter removing mechanism forcefully removes waste matter that would impair uniform generation of free abrasive particles from the fixed abrasive, such as waste matter produced by polishing, large particles in the free abrasive particles, large particles remaining on the polishing surface of the polishing tool, and waste matter produced by the irradiation with light, thereby eliminating factors causing unstable polishing and thus enabling stable supply of abrasive particles during polishing. The polishing tool is, typically, a member separate from the waste matter removing mechanism.

According to a second feature of the present invention, polishing apparatus 203 (FIG. 4) has the first feature. Further, the waste matter removing mechanism includes a dresser 32A formed so as to be capable of pressing against polishing surface 15. The dresser 32A includes diamond particles. Preferably, the dresser 32A is used under a relatively small pressure, e.g. 0.5 psi, with a view to preventing falling off of diamond particles. In general, dressing is performed at 0.5 psi, by way of example. With this arrangement, waste matter can be surely removed with the dresser 32A.

According to a third feature of the present invention, polishing apparatus 204 (FIG. 5) has the first feature. Further, waste matter removing mechanism 32B has a brush (nylon brush) 37 formed so as to be capable of rubbing against polishing surface 15. With this arrangement, waste matter on the polishing surface 15 can be surely removed with the brush 37. Thus, it is possible to surely remove waste matter from the polishing surface 15 with a simple arrangement, without making a scratch on the polishing surface 15.

According to a fourth feature of the present invention, polishing apparatus 205 (FIG. 6) has the first feature. Further, the waste matter removing mechanism is a fluid mixture generator 32C for generating a pressure-controlled fluid mixture of a gas and a liquid and spraying it toward polishing surface 15. With this arrangement, waste matter on the polishing surface 15 can be surely removed without allowing the polishing surface 15 to contact any solid, by adjusting spray pressure and an amount of fluid mixture according to size, properties, and the like of the waste matter.

According to a fifth feature of the present invention, polishing apparatus 206 (FIG. 7) has the first feature. Further, the waste matter removing mechanism is an ultrasonic wave generator 32D for generating an ultrasonic wave toward polishing surface 15. With this arrangement, waste matter on the polishing surface 15 can be surely removed without allowing the polishing surface 15 to contact any solid, by adjusting ultrasonic wave output or a distance between the ultrasonic wave generator 32D and the polishing surface 15 according to size, properties, and the like of the waste matter.

According to a sixth feature of the present invention, the polishing apparatus 205 (FIG. 6) has the first feature and further has a first-liquid supply device 32C for supplying a first liquid onto the polishing surface when the above-described irradiation with light is performed. The waste matter removing mechanism is a second-liquid supply device 32C for supplying a second liquid onto the polishing surface 15 to remove waste matter. The first liquid and the second liquid are different from each other. With this arrangement, when light irradiation is performed, the first liquid (e.g. a photosensitizer) most suitable for the irradiation is supplied to promote generation of free abrasive particles from the fixed abrasive, and when removal of waste matter is performed, the second liquid (e.g. an oxidizing agent having an action of oxidatively decomposing the binder) most suitable for this waste matter removal is supplied, so that it is possible to promote the removal of waste matter that would impair generation of free abrasive particles from the fixed abrasive.

According to a seventh feature of the present invention, polishing apparatus 207 (FIG. 8) has the first feature. Further, the waste matter removing mechanism is a vacuum suction device 32E for sucking in waste matter by a vacuum. With this arrangement, waste matter can be removed without allowing the waste matter removing mechanism to contact polishing surface 15, or without using a second liquid or the like that requires a treatment. Accordingly, a polishing operation can be made even more efficient.

According to an eighth feature thereof, the present invention is applied to a method of dressing a polishing surface of a polishing tool. The polishing surface includes abrasive particles and a binder for bonding together the abrasive particles, and is used in a polishing step in which the polishing surface is pressed against a substrate and moved relative thereto to polish the substrate. The dressing method includes a light ray irradiation step of irradiating the polishing surface with light rays for weakening a bond force of the binder, and a waste matter removing step of forcefully removing waste matter from the polishing surface. The waste matter removing step includes a waste matter removing step of forcefully removing waste matter generated on the polishing surface during the polishing step and waste matter generated on the polishing surface during the light ray irradiation step.

According to a ninth feature of the present invention, the dressing method has the eighth feature. Further, the waste matter removing step includes a step of pressing a dresser against the polishing surface, with the dresser including diamond particles.

According to a tenth feature of the present invention, the dressing method has the eighth feature. Further, the waste matter removing step includes a step of rubbing a brush (nylon brush) against the polishing surface.

According to an eleventh feature of the present invention, the dressing method has the eighth feature. Further, the waste matter removing step includes a step of spraying the polishing surface with a pressure-controlled fluid mixture of a gas and a liquid.

According to a twelfth feature of the present invention, the dressing method has the eighth feature. Further, the waste matter removing step includes a step of irradiating the polishing surface with an ultrasonic wave.

According to a thirteenth feature of the present invention, the dressing method has the eighth feature. Further, the light ray irradiation step includes a step of supplying a first liquid onto the polishing surface. The waste matter removing step includes a step of supplying the polishing surface with a second liquid different from the first liquid. With this arrangement, the polishing surface is supplied with the first liquid (e.g. a photosensitizer) to allow an optical dressing effect to be promoted or maintained. Further, the polishing surface is supplied with the second liquid (e.g. an oxidizing agent having an action of oxidatively decomposing the binder, thereby allowing removal of waste matter that would impair generation of free abrasive particles from the fixed abrasive.

According to a fourteenth feature of the present invention, the dressing method has the eighth feature. Further, the waste matter removing step includes a step of sucking in waste matter by a vacuum.

According to a fifteenth feature thereof, the present invention is applied to a method of dressing a polishing surface of a polishing tool. The polishing surface includes abrasive particles and a binder for bonding together the abrasive particles, and is used in a polishing step in which the polishing surface is pressed against a substrate and moved relative thereto to polish the substrate. The dressing method includes a light ray irradiation step of irradiating the polishing surface of the polishing tool with light rays for weakening a bond force of the binder. The light ray irradiation step is performed during the polishing step, in which the substrate is polished with the polishing tool, and also performed between one polishing step and a subsequent polishing step. With this arrangement, the light ray irradiation step is performed simultaneously with the polishing step and also performed between the one polishing step and the subsequent polishing step. Therefore, even if progress of dressing of the polishing surface is slow, the polishing surface can be dressed satisfactorily.

According to a sixteenth feature of the present invention, the dressing method has the fifteenth feature. Further, the polishing step is performed by rotating the polishing tool. A number of revolutions of the polishing tool during a time when the polishing step is not performed is not more than 10 revolutions per minute. With this arrangement, during the time when the polishing step is not performed, the polishing tool is rotated at a low speed even more suitable for dressing at which a dressing accelerator or the like supplied to the polishing surface during dressing is unlikely to be splashed from the polishing surface. Thus, an effect of dressing can be enhanced.

According to a seventeenth feature of the present invention, the dressing method has the fifteenth or sixteenth feature. Further, when a rate of dressing in the light ray irradiation step is high, the light ray irradiation step performed simultaneously with the polishing step is intermittently performed. When a rate of dressing is low, the light ray irradiation step is further performed between the one polishing step and the subsequent polishing step. With this arrangement, dressing time is shortened or lengthened according to whether the rate of dressing is high or low, so that stock removal during dressing of the polishing surface can be adjusted to an appropriate value.

EXPLANATION OF REFERENCE SYMBOLS

Figure 1:
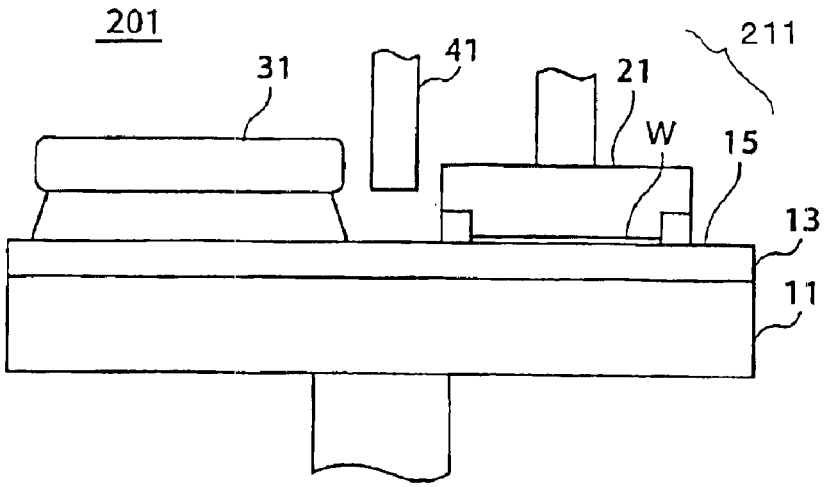
FIG. 1 is a schematic front view of a polishing apparatus according to a first embodiment of the present invention.

11: turntable; 13: fixed abrasive (polishing tool); 15: polishing surface; 21: top ring; 31: light source; 32: waste matter removing device (waste matter removing mechanism); 32A: dresser; 32B: waste matter removing device (waste matter removing mechanism); 32C: atomizer; 32D: ultrasonic wave generator; 32E: vacuum suction device (vacuum suction mechanism); 34: laser beam outlet; 35: laser beam; 37: nylon brush (brush); 38: dressing mechanism; 40: pure water supply source; 41: supply device; 42: gas supply source; 43: second-chemical liquid supply source; 44: first-chemical liquid supply source; 45: vacuum supply source; 144, 145: top ring; 146, 147: turntable; 146A, 147A: fixed abrasive (polishing tool); 146B, 147B: polishing surface; 148, 149: turntable; 150, 151: polishing solution supply nozzle; 152, 153: atomizer; 154, 155, 156, 157: dresser; 160: rotary transporter; 164, 165: pusher; 168: mechanical dressing mechanism; 192, 193: optical dressing mechanism; 201 to 208: polishing apparatus; 211: moving mechanism; W: substrate (semiconductor wafer).

DETAILED DESCRIPTION OF THE PREFERRED EMBODIMENTS

Embodiments of the present invention will be described below with reference to the accompanying drawings. It should be noted that in the drawings the same or equivalent members are denoted by the same reference symbols, and a redundant description is omitted.

FIG. 1 is a schematic front view showing a polishing apparatus 201 according to a first embodiment of the present invention. The polishing apparatus 201 has a rotating turntable 11 and a fixed abrasive 13 provided on the turntable 11. In this embodiment, the fixed abrasive 13 constituting a polishing tool is formed by including abrasive particles (not shown) and a binder (not shown) for fixing (bonding) together the abrasive particles.

Examples of substances usable as materials for the abrasive particles of the fixed abrasive 13 are silicon oxide ($SiO_2$), alumina ($Al_2O_3$), cerium oxide ($CeO_2$), silicon carbide (SiC), zirconia (ZrO), iron oxides (FeO, $Fe_3O_4$), manganese oxides ($MnO_2$, $Mn_2O_3$), magnesium oxide (MgO), calcium oxide (CaO), barium oxide (BaO), zinc oxide (ZnO), barium carbonate ($BaCO_3$), diamond (C) and titanium oxide ($TiO_2$).

Examples of usable binder materials are thermosetting resins such as epoxies (EP), phenols (PF), ureas (UF), melamines (MF), unsaturated polyesters (UP), silicones (SI) and polyurethanes (PUR), and thermoplastic resins such as those known as general-purpose plastics, i.e. polyvinyl chloride (PVC), polyethylene (PC), polycarbonate (PC), polypropylene (PP), polystyrene (PS), acrylonitrile butadiene styrene (ABS), acrylonitrile styrene (AS), butadiene-styrene-methyl methacrylate (MBS), polymethyl methacryl (PMMA), polyvinyl alcohol (PVA), polyvinylidene chloride (PVDC) and polyethylene terephthalate (PET), those known as general-purpose engineering plastics, i.e. polyamide (PA), polyacetal (POM), polyphenylene ether [PPE (modified PPO)], polybutylene terephthalate (PBT), ultra-high-molecular-weight polyethylene (UHMW-PE) and polyvinylidene fluoride (PVDF), those known as super engineering plastics, i.e. polysulfone (PSF), polyether sulfone (PES), polyphenylene sulfide (PPS), polyarylate (PAR), polyamide-imide (PAI), polyether imide (PEI), polyether ether ketone (PEEK), polyimide (PI), liquid crystal polymers (LCP), polytetrafluoroethylene (PTFE), polystyrene methacrylate resin, polycarbonate cellulose acetate, polyacetal polyamide, polypropylene polyethylene, ethylene trifluoride resin, vinylidene fluoride resin, polyester resin, and diallyl phthalate. These resins may be used in the form of a mixture of two or more of them. It is also possible to copolymerize monomer components of these resins.

Examples of resin materials suitable for use when desiring to use a non-rigid tool are polyvinyl fluoride, polyvinylidene fluoride, polychlorotrifluoroethylene, vinyl fluoride, vinylidene fluoride, dichlorofluoroethylene, vinyl chloride, vinylidene chloride, perfluoro-α-olefins (e.g. hexafluoropropylene, perfluorobutene-1, perfluoropentene-1, and perfluorohexene-1), perfluorobutadiene, chlorotrifluoroethylene, trichloroethylene, tetrafluoroethylene, perfluoroalkyl perfluorovinyl ethers (e.g. perfluoromethyl perfluorovinyl ether, perfluoroethyl perfluorovinyl ether, and perfluoropropyl perfluorovinyl ether), alkyl vinyl ethers having 1 to 6 carbon atoms, aryl vinyl ethers having 6 to 8 carbon atoms, alkyls having 1 to 6 carbon atoms, aryl perfluorovinyl ethers having 6 to 8 carbon atoms, ethylene, propylene, styrene, polyvinylidene fluoride, polyvinyl fluoride, vinylidene fluoride-tetrafluoroethylene copolymer, vinylidene fluoride-hexafluoropropylene copolymer, tetrafluoroethylene-ethylene copolymer, tetrafluoroethylene-propylene copolymer, ethylene-chlorotrifluoroethylene copolymer, tetrafluoroethylene-chlorotrifluoroethylene copolymer, tetrafluoroethylene-hexafluoropropylene copolymer, tetrafluoroethylene-perfluoromethyl perfluorovinyl ether copolymer, tetrafluoroethylene-perfluoropropyl perfluorovinyl ether copolymer, tetrafluoroethylene-hexafluoropropylene-perfluoromethyl perfluorovinyl ether copolymer, tetrafluoroethylene-hexafluoropropylene-perfluoroethyl perfluorovinyl ether copolymer, and tetrafluoroethylene-hexafluoropropylene-perfluoropropyl perfluorovinyl ether copolymer.

If foaming characteristics, cost efficiency, availability, and the like are taken into consideration, preferable resin materials are the above-mentioned polyvinylidene fluoride, polychlorotrifluoroethylene, vinylidene fluoride-hexafluoropropylene copolymer, ethylene-tetrafluoroethylene copolymer, ethylene-chlorotrifluoroethylene copolymer, tetrafluoroethylene-perfluoroalkyl perfluorovinyl ether copolymers, and tetrafluoroethylene-hexafluoropropylene copolymer. Even more preferable resin materials are partially fluorinated resins such as polyvinylidene fluoride and vinylidene fluoride-hexafluoropropylene copolymer, and perfluoro resins such as tetrafluoroethylene-perfluoroalkyl perfluorovinyl ether copolymers.

The above-described binder is an organic substance. Therefore, when predetermined light is applied to polishing surface 15 of the fixed abrasive 13, molecular bonds are broken by irradiation energy of light rays. Consequently, a retaining force of the binder for retaining the abrasive particles weakens, thereby allowing free abrasive particles to be generated from the fixed abrasive. Thus, optical dressing of the polishing surface 15 is effected. Generation of free abrasive particles can be promoted with light rays of lower energy by using a photo-reactive fixed abrasive 13 mixed with a photocatalytic substance, e.g. $TiO_2$ or ZnO, as stated above. Abrasive particles participating in polishing are free abrasive particles generated from the fixed abrasive 13, and abrasive particles fixed to the fixed abrasive 13 but exposed on the polishing surface 15 of the fixed abrasive 13. Optical dressing of the polishing surface 15 allows promotion of generation of free abrasive particles having a polishing action.

The polishing apparatus 201 further has a light source 31, e.g. a mercury-vapor lamp or a low-pressure mercury-vapor lamp. By irradiation with predetermined light rays from the light source 31, molecular bonds of the binder constituting the fixed abrasive 13 are broken, thereby generating free abrasive particles from the fixed abrasive 13, as stated above. The polishing apparatus 201 further has a supply device 41 for supplying a first chemical liquid (containing an agent) as a first fluid onto the polishing surface 15. Supply of an appropriate first chemical liquid in combination with irradiation with appropriate light rays allows promotion of generation of free abrasive particles. Thus, dressing can be promoted or maintained. The first chemical liquid to be supplied is preferably a boron-containing substance, e.g. a borate. Supply of a boron-containing substance in combination with light ray irradiation of the fixed abrasive allows free abrasive particles to be sufficiently generated from the fixed abrasive and hence permits dressing to be performed stably. The first chemical liquid may be a chemical liquid containing an oxidizing agent, e.g. $O_3$ or $H_2O_2$.

The polishing apparatus 201 has a top ring 21. The top ring 21 holds a substrate W, as an object to be polished, and slides while pressing the substrate W against the polishing surface 15 of the fixed abrasive 13. The top ring 21 and the turntable 11 form a moving mechanism 211 that causes the top ring 21 and the turntable 11 to move relative to each other while pressing the substrate W against the polishing surface 15. The polishing apparatus 201 polishes the substrate W, e.g. a semiconductor wafer, as an object to be polished, with the fixed abrasive 13 on the turntable 11. While doing so, the polishing apparatus 201 applies light rays to the polishing surface 15 of the fixed abrasive 13 by using the light source 31, thereby allowing the polishing surface 15 to be dressed.

Figure 2:
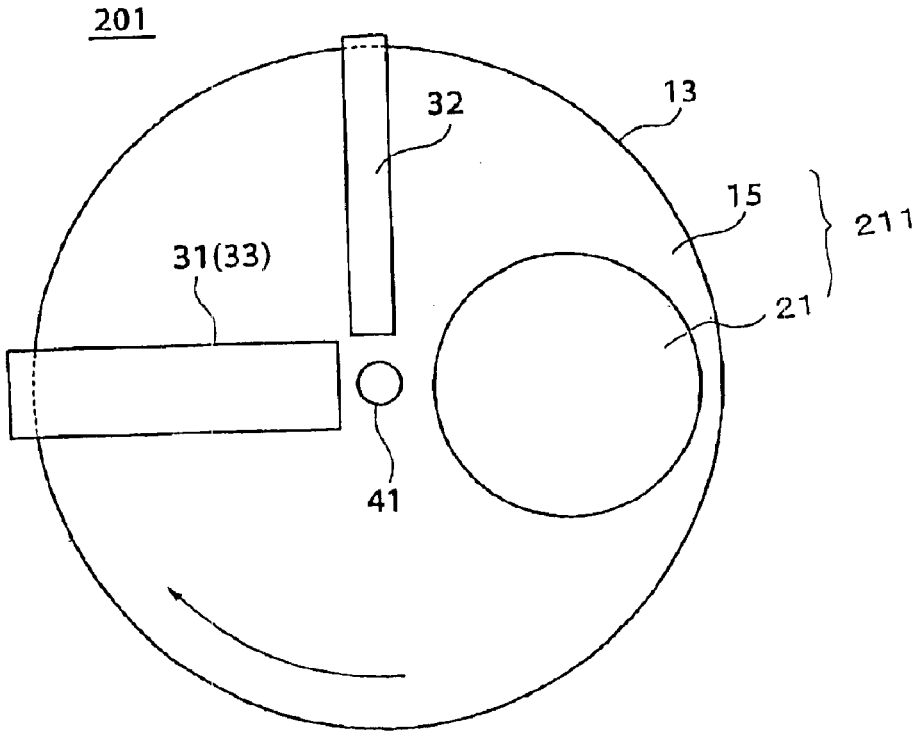
FIG. 2 is a schematic plan view of the polishing apparatus shown in FIG. 1

As shown in FIG. 2, the polishing apparatus 201 has a waste matter removing device 32. The waste matter removing device 32 removes waste matter produced on the polishing surface 15 by mechanical or optical dressing of the fixed abrasive 13, and also removes waste matter resulting from polishing of the substrate W with the fixed abrasive 13. Examples of the waste matter removing device 32 are a dresser, a waste matter removing mechanism having a nylon brush, an atomizer, an ultrasonic wave generator, a vacuum suction device, and the like as will be described later.

Figure 3:
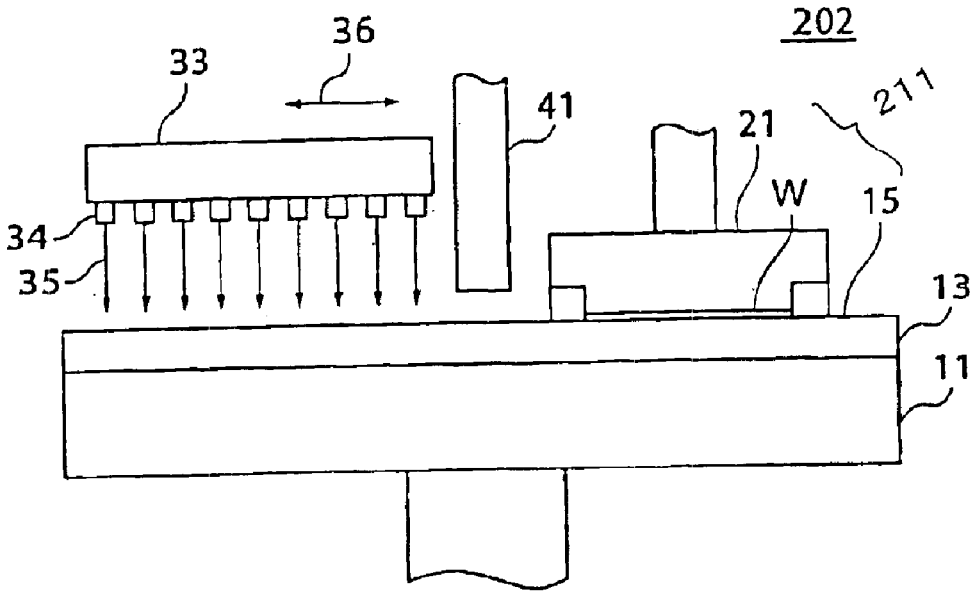
FIG. 3 is a schematic front view of a polishing apparatus according to a second embodiment of the present invention.

FIG. 3 is a schematic front view showing a polishing apparatus 202 according to a second embodiment of the present invention. In the polishing apparatus 202, a laser source 33 is used as a light source to apply laser beams to fixed abrasive 13. The laser source 33 has a large number of laser beam outlets 34 to apply laser beams 35 thoroughly to an irradiated part (polishing surface 15) of the fixed abrasive 13 (with a circular planar configuration). The laser source 33 is capable of oscillating in directions indicated by double-headed arrow 36 in the figure (in horizontal directions parallel to a radial direction of the polishing surface 15). Thus, it is possible to avoid local concentration of laser beams 35 and, at the same time, possible to provide a high energy density to a surface (polishing surface 15) of the fixed abrasive 13 by irradiation with intense laser beams 35. Accordingly, free abrasive particles can be generated efficiently from the fixed abrasive. That is, a dressing effect can be applied to the polishing surface 15. In this embodiment also, the polishing apparatus 202 has a supply device 41 for supplying a first chemical liquid onto the polishing surface 15 when light irradiation is being performed. The supply device 41 supplies a boron-containing substance, e.g. a borate, as the first chemical liquid. Combining supply of a boron-containing substance with irradiation with an appropriate laser beam allows favorable dressing to be performed.

It is also possible to scan a laser beam by employing a laser scanning method using a galvanometer mirror or the like. Use of a galvanometer mirror allows a single laser beam to be applied over a wide range. It is also possible to use a plurality of laser scanning units, each comprising a combination of a laser source and a scanning device. Alternatively, a plurality of laser beams may be simultaneously scanned by one or a plurality of scanning devices.

In general, the above-described resin materials that may be used as the binder are compounds having C—H bonds or C—C bonds. By breaking terminal groups (—H) and the C—C bonds at a surface of the binder and substituting desired functional groups into remaining bonding arms, abrasive particles can be freed at a surface of the fixed abrasive 13. In other words, it is possible to promote generation of free abrasive particles from the fixed abrasive 13 and hence possible to perform dressing of the fixed abrasive 13. That is, it is possible to obtain the same effect as in a case of dressing performed by using a diamond tool or the like. In general, bond energies of C—H and C—C of resins are 98 kcal/mol and 80.6 kcal/mol, respectively. Accordingly, molecular bonds can be broken if the resin material is irradiated with light rays having a photon energy more than the bond energies and the light rays are absorbed by irradiated material in excess of the bond energies.

There are light sources satisfying the above-described conditions, such as KrF excimer laser light having a wavelength of 248 nm and a photon energy of 114 kcal, ArF excimer laser light having a wavelength of 193 nm and a photon energy of 147 kcal, and Xe excimer lamp light having a wavelength of 172 nm and a photon energy of 162 kcal. These light sources have a narrow wavelength distribution and are capable of irradiation with light rays of high energy, but suffer from a problem of increased cost. In this regard, it is possible to use a low-pressure mercury-vapor lamp capable of strongly emitting light of 253.7 nm and 184.9 nm, which are resonance lines of mercury, although it has a wide wavelength distribution. With the low-pressure mercury-vapor lamp, a low-cost light source for optical dressing can be obtained.

In a resin molecule, a C—H bond, for example, has a bond energy of 80.6 kcal/mol. Energy required to break the bond to generate free abrasive particles from the fixed abrasive may be determined by a trial calculation as follows. A relationship between energy and wavelength is given by $$E=h/v$$

where h is Planck's constant, and v is velocity.

Accordingly, assuming that all photon energy can be absorbed by an irradiated surface, the above-described molecular bond can be broken by irradiation with light having a wavelength of 351 nm or less.

In the above-described optical dressing using photon energy, bonds of the binder in the fixed abrasive are broken by a photochemical reaction. Consequently, the fixed abrasive becomes unable to retain abrasive particles, thus allowing free abrasive particles to be generated from the fixed abrasive. However, bonding arms of the binder cut off by the photochemical reaction recombine with abrasive particles if left to stand as they are. Accordingly, the free abrasive particles are fixed to the binder again. Therefore, it is important to prevent recombination of the free abrasive particles with the binder broken by the photochemical reaction. By doing so, an amount of free abrasive particles generated from the fixed abrasive can be stabilized and also increased. Experiments performed by the present inventors revealed that a significant optical dressing effect is obtained when ultraviolet radiation is applied to the fixed abrasive in addition to supply of an ionic aqueous solution of sodium borate, which is a borate containing boron, in a case of using an epoxy resin or MBS resin as a binder for the fixed abrasive. The first chemical liquid is generally known as a standard buffer solution [borate pH standard solution; pH=9.18 (25° C.)].

Table 1 below shows experimental results in a case where the first chemical liquid was supplied during optical dressing of a fixed abrasive using an epoxy resin as a binder.

This experiment was conducted by using cerium oxide particles as abrasive particles, an epoxy resin as a binder, and a low-pressure mercury-vapor lamp 31 (see FIG. 1) as a light source. In this experiment, first, the polishing surface 15 of the fixed abrasive 13 (see FIGS. 1 and 3) was subjected to mechanical dressing with a diamond dresser (not shown in FIGS. 1 and 3) as a dresser. Then, a semiconductor wafer W as a first substrate was polished for 10 minutes. Subsequently, a second semiconductor wafer W was polished for 10 minutes, following polishing of the first semiconductor wafer W. i.e. without performing mechanical dressing on the polishing surface 15. Thereafter, the polishing surface 15 of the fixed abrasive 13 was supplied with the first chemical liquid and irradiated with ultraviolet rays for 30 minutes. In another test condition, irradiation with ultraviolet rays was not performed. Then, the polishing surface 15 was left to stand for 30 minutes. Thereafter, a third semiconductor wafer W (see FIGS. 1 and 3) was polished. As the first chemical liquid to be supplied, three different kinds of liquids were used: pure water (DIW; Deionized Water); alkali solution (KOH); and a standard buffer solution [borate pH standard solution); pH=9.18 (25° C.)]. Table 1 shows a polishing rate of the semiconductor wafer W in each combination of the above-described conditions.

That is, in Test Nos. 1 and 2, only pure water was supplied as the first chemical solution. Test Nos. 1 and 2 differed from each other in regard to whether light irradiation was performed or not. As a result, polishing rates of 26 (Å/min) and 27 (Å/min) were obtained in Test Nos. 1 and 2, respectively, in polishing immediately after the mechanical dressing with the diamond tool. In the subsequent polishing of the second semiconductor wafer W, the polishing rates in Test Nos. 1 and 2 reduced to a considerable extent, i.e. to 3 (Å/min) and 5 (Å/min), respectively. It is revealed that the amount of free abrasive particles generated from the fixed abrasive was extremely small, particularly in the polishing of the second semiconductor wafer W. In the polishing of the third semiconductor wafer W also, when light irradiation was performed with pure water being supplied, the polishing rate increased slightly to 12 (Å/min), which is, however, an extremely low value for a polishing rate. When light irradiation was not performed, the polishing rate was on the order of 3 (Å/min). Thus, it is revealed that when light irradiation was not performed, there was no effect of dressing and hence there was no increase in an amount of free abrasive particles generated from the fixed abrasive.

In Test Nos. 3 and 4, before polishing the third semiconductor wafer W, an alkali solution was supplied, and while doing so, light irradiation was performed in Test No. 3 but not performed in Test No. 4. The wafer W polishing rates in polishing of the first and second semiconductor wafers W were similar to the above. When light irradiation was performed with the alkali solution being supplied in dressing performed prior to the polishing of the third semiconductor wafer W, the polishing rate increased slightly, i.e. 18 (Å/min). However, when light irradiation was not performed, the polishing rate was 8 (Å/min). Thus, it is revealed that there were almost no free abrasive particles generated from the fixed abrasive. That is, there was substantially no effect of dressing.

In Test Nos. 5 and 6, a borate pH standard solution was used as a first chemical liquid to be supplied. These tests were to make a comparison between a case where light irradiation was performed and a case where light irradiation was not performed in the same way as above. Results of polishing of the first and second semiconductor wafers W were similar to above. Regarding the result of polishing the third semiconductor wafer W, it should be noted that Test No. 5, in which light irradiation was performed, provided a high polishing rate, i.e. 94 Å/min. It is considered that in Test No. 5 generation of free abrasive particles from the fixed abrasive was surely effected by a combination of supply of the standard buffer solution and the light irradiation. That is, molecular bonds of the resin were broken by the light irradiation, and cut portions of the molecular bonds were terminated by an effect of the standard buffer solution. Even when light irradiation was not performed, use of borate pH standard solution provided a polishing rate of 21 (Å/min), which was a large value in comparison to Test Nos. 1 to 4.

The above-described results reveal that the combination of light irradiation with supply of the borate pH standard solution extremely increased an amount of free abrasive particles generated from the fixed abrasive, and thus provided a favorable dressing effect. When the alkali solution was supplied as the first chemical liquid, some improvement in the polishing rate was recognized. It is considered that the improvement in the polishing rate was obtained by an effect on polishing of alkali abrasive particles absorbed in the fixed abrasive 13. Similarly, an improvement in the polishing rate was recognized in the case where the standard buffer solution [borate pH standard solution; pH=9.18 (25° C.)] was used, but light irradiation was not performed. This is considered due to the fact that the effect of the supply of the standard buffer solution (borate pH standard solution) was more powerful than the effect of the alkali solution.

Next, a fixed abrasive using a methyl methacrylate butadiene styrene (MBS) resin will be described. The MBS resin is a copolymer containing methyl methacrylate butadiene styrene as a main raw material, which is used mainly as a modifier for improving impact resistance of vinyl chloride resins or acrylic resins. Regarding general fixed abrasives in which a vinyl chloride or acrylic resin with MBS added thereto is used as a binder, an amount of MBS added is on the order of several to 20%. This is a design placing emphasis on characteristics of vinyl chloride. In contrast, when a proportion of MBS in the resin is increased to 20% or more, or further to 50% or more, or even further to 100%, a tool exhibiting a significant shock and impact absorbing effect is obtained. Besides MBS, resins having an elastomer (e.g. EPR, butadiene rubber, or ethylene propylene rubber) dispersed therein and core-shell type resins having an elastomer as a core exhibit similar effects. Examples of such resins are PP block polymer (impact copolymer), PMMA, TPE, HIPS, ABS, AES, SBS, SEBS, SEPS, EVA, CPE, MBS, PET, PBT, and TPU, which may be used singly or as an additive. With these resins, effects similar to those stated above can be expected.

It is possible to obtain a fixed abrasive suffering a very small incidence of scratches during polishing by using MBS resin as a binder in combination with ceria abrasive particles. It is also possible to mix MBS resin with other resin. For example, an epoxy resin and MBS resin may be mixed together for use as a binder. That is, because MBS resin is a thermoplastic resin, the fixed abrasive is easy to produce by performing a molding process, and strength of these moldings is high. In addition, when MBS resin is used as a binder, free abrasive particles can be efficiently generated from the fixed abrasive. Thus, a high polishing rate can be obtained. For example, it is possible to obtain a polishing rate approximately double that in the case of the conventional fixed abrasive using an epoxy resin (not containing MBS resin) as a binder. Further, because the resin per se has impact resistance, force acting on the abrasive particles during polishing is lessened (suppressed). Accordingly, it becomes possible to perform polishing without making a scratch on a substrate. That is, polishing suffering minimal defects can be performed. It is considered that the MBS resin-bonded abrasive expands structurally by performing a water-absorbing effect, and its capability of retaining abrasive particles is reduced by light irradiation, thereby facilitating generation of free abrasive particles from the fixed abrasive.

The fixed abrasive has characteristic features of polishing rate being high, and a number of scratches generated on a substrate being minimal, in comparison to general fixed abrasives using a phenolic or epoxy resin, as stated above. Therefore, the fixed abrasive can also be used in semiconductor manufacturing processes, in which generation of scratches is unfavorable. If the fixed abrasive is used in a process requiring a high polishing rate at which general fixed abrasives using a phenolic or epoxy resin would need dressing simultaneously during polishing, a required high polishing rate can be obtained without need to perform dressing during polishing. Further, because there is no danger of diamond abrasive particles falling off during dressing, scratches due to diamond particles will not occur.

Table 2 below shows experimental results of dressing performed on a fixed abrasive using MBS resin as a binder. Other experimental conditions are the same as those in Table 1. That is, cerium oxide particles were used as abrasive particles, and MBS resin was used as a binder. Further, a low-pressure mercury-vapor lamp was used as a light source. Polishing conditions were as follows. A first semiconductor wafer W was polished after mechanical dressing had been performed with a diamond tool. Polishing of a second semiconductor wafer W was performed following the polishing of the first semiconductor wafer W. Thereafter, a first chemical liquid was supplied with or without light irradiation being performed to perform dressing. Then, polishing of a third semiconductor wafer W was performed.

Results of the polishing rate comparison shown in Table 2 are as follows. In Test Nos. 1 and 2, only pure water was supplied as the first chemical solution. Test Nos. 1 and 2 differed from each other in regard to whether light irradiation was performed or not to make a polishing rate comparison. As shown in Table 2, there is no significant difference in the polishing rates for the first, second and third semiconductor wafers W. The fixed abrasive using MBS resin has a feature in that a rate of reduction of polishing rate due to continuous polishing is smaller than in the case of the fixed abrasive using an epoxy resin as a binder, as has been stated above. When pure water is supplied as the first chemical liquid and light irradiation is not performed, the polishing rate tends to lower gradually. However, when light irradiation is performed, the polishing rate does not lower but remains stable. When the standard buffer solution [borate pH standard solution; pH=9.18 (25° C.)] was supplied as the first chemical liquid and light irradiation was performed, polishing performance was improved to a level nearly equal to the initial polishing rate. That is, in the case of the fixed abrasive using MBS resin also, a polishing rate close to that attained by mechanical dressing with a diamond dresser can be obtained by optical dressing combined with supply of a borate solution.

Another effective way of dressing the fixed abrasive is to supply an oxidizing agent exhibiting action of oxidatively decomposing a polymer resin used as a binder for fixing abrasive particles simultaneously with light irradiation. Examples of usable oxidizing agents are ozone water, hydrogen peroxide water, organic peroxides such as peracetic acid, perbenzoic acid and tert-butyl hydroperoxide, permanganate compounds such as potassium permanganate, dichromate compounds such as potassium dichromate, halogen acid compounds such as potassium iodate, nitric acid and nitric acid compounds such as iron nitrate, perhalogen acid compounds such as perchloric acid, transition metal salts such as potassium ferricyanide, persulfates such as ammonium persulfate, and heteropoly acid salts. Among these oxidizing agents, hydrogen peroxide water and organic peroxides are preferable from a practical point of view because decomposition products resulting from use of these are harmless.

Because they are unstable, the above-described peroxides produce radicals, and unpaired electrons thereof readily oxidize the binder resin. Hydrogen peroxide is decomposed by ultraviolet radiation to produce hydroxyradicals. An H—OH bond dissociation energy of the hydroxyradicals is about 120 kcal/mol, which is greater than an R—H bond dissociation energy of any resin. Accordingly, the R—H of the binder resin is dissociated by the hydroxyradicals to produce R radicals. The R radicals further react with the hydroxyradicals and so forth, thereby oxidatively decomposing the binder resin. Concentration of the hydrogen peroxide is 0.001 wt % to 60 wt %, and the pH thereof is 1 to 14, preferably 8 to 10. A wavelength of ultraviolet radiation is preferably 450 nm or less.

These oxidizing agents exhibiting an oxidative decomposition action degrade oxidatively the polymer resin used as the binder to break a main chain and decompose the polymer resin so as to form it into a lower-molecular compound, thereby mechanically weakening a surface layer of the fixed abrasive and removing the surface layer, thus promoting generation of free abrasive particles from the fixed abrasive. By irradiating the fixed abrasive with the above-described light rays during dressing using an oxidizing agent exhibiting such an oxidative decomposition action, a synergistic effect can be applied to optical dressing that promotes generation of free abrasive particles from the fixed abrasive.

Further, a photoinitiator (photosensitizer) may be mixed into the fixed abrasive or contained in the first chemical liquid to be supplied to the fixed abrasive during optical dressing. This is also effective for the optical dressing. If the fixed abrasive surface is irradiated with light rays, e.g. ultraviolet rays, under a condition where a photoinitiator (photosensitizer) is used as stated above, the photoinitiator (photosensitizer) absorbs the ultraviolet rays to produce radicals or ions by cleavage or dehydrogenation, thereby decomposing a surface layer of the binder resin constituting the fixed abrasive and thus promoting generation of free abrasive particles from the fixed abrasive. Examples of usable photoinitiators (photosensitizers) are acetophenone, diacetyl, 2,2'-azobisisobutyronitrile, anthraquinone, iron chlorides, 1,1-diphenyl-2-picrylhydrazine (DPPH), iron dimethylcarbamates, thioxanthone, tetramethylthiuram sulfide, 1,4-naphthoquinone, p-nitroaniline, phenanthrene, benzyl, 1,2-benzoanthraquinone, p-benzoquinone, benzophenone, Michler's ketone, 2-methylanthraquinone, and 2-methyl-1,4-naphthoquinone (vitamin K3). Concentration of the photoinitiator (photosensitizer) in the fixed abrasive is preferably on the order of 0.05 to 10%, more preferably on the order of 0.1 to 5%. Effective excitation wavelength of ultraviolet rays suitable for the photoinitiator (photosensitizer) is on the order of 257 nm in a case of thioxanthone, by way of example. For 1,4-naphthoquinone, it is on the order of 251 nm.

To promote optical dressing, it is preferable to use a photosensitive resin for a part or an entirety of the resin constituting the fixed abrasive and to supply a solution capable of dissolving the resin after exposure as the first chemical liquid to be supplied during optical dressing. Photosensitive resins, particularly positive ones, which react upon light irradiation to change in physical properties, are denatured or decomposed and depolymerized at a part irradiated with light during the optical dressing, thus becoming easier to dissolve in a solution (organic solvent, aqueous alkali solution, or pure water) capable of dissolving the resin after exposure. Therefore, a fixed abrasive is formed by mixing together a positive photosensitive resin and abrasive particles, together with another binder resin as occasion demands. The fixed abrasive is irradiated with light rays, e.g. ultraviolet rays. Further, a solution capable of dissolving the resin after this exposure is brought into contact with the fixed abrasive surface, thereby dissolving the positive photosensitive resin, together with the other binder resin. Thus, it is possible to promote generation of free abrasive particles from the fixed abrasive. An organic solvent for use in the solution capable of dissolving the resin after the exposure is selected in accordance with dissolution characteristics of the photosensitive resin after the exposure. When an aqueous alkali or acid solution is used, dissolution can be promoted by an acid-alkali neutralizing reaction.

When a photodegradation type PMMA (polymethyl methacrylate) or PMIPK (polymethyl isopropenyl ketone), for example, is used as a positive photosensitive resin, a molecular weight of the resin is reduced by exposure, so that it can be dissolved by using a mixed solution of organic solvents, e.g. methyl isobutyl ketone and isopropyl alcohol, as a solution capable of dissolving the resin after the exposure. When a dissolution inhibition type novolak resin and an o-diazonaphthoquinone compound are used, indene carboxylic acid is produced by the exposure, and this is dissolved in an alkali solution. When polyvinyl alcohol, which is a water-soluble resin, and a photosensitive composition are mixed together, this mixture can be dissolved by using water as a solution capable of dissolving the resin after the exposure. Preferable resins usable as the positive photosensitive resin are —($CH_2$—$CR_1R_2$)—, where $R_1$ is $CH_3$, and $R_2$ is —H, —$CH_3$, —COOH, —$COOCH_3$, —$COOC_2H_5$, —$COOC_3H_7$, —$COOC_4H_9$, —$COOC_5H_{11}$, —$COOCH_2CF_2CHF$—$CF_3$, —$C_6H_5$, —$CONH_2$, CN, —$COCH_3$, and copolymers of these resins.

To promote optical dressing by adding a photosensitive resin to the fixed abrasive, it is preferable not to add, if possible, an oxidation inhibitor, an ultraviolet light absorber, a photostabilizer, a radical inhibitor, a metal inactivating agent, a peroxide decomposing agent, and the like that are contained in general binder resins. The above-described dressing enables polishing to be performed stably under supply of sufficient free abrasive particles generated from the fixed abrasive.

When dressing by light irradiation is performed, an incompletely dissolved resin may remain locally on a surface of the fixed abrasive after the irradiation. This resin is a part of the original resin dissolved and denatured by the irradiation and has different physical properties from those of the original resin. Accordingly, this denatured resin does not exhibit an effect of lessening attack on a surface to be polished of the substrate and antiscratching and other effects, which the original resin has. Further, the irradiated surface of the fixed abrasive must have become uniform by polishing substrates. However, if the irradiated surface of the fixed abrasive is viewed minutely, an incompletely dissolved resin may remain as stated above. Thus, the surface of the fixed abrasive may be non-uniform. Therefore, if the fixed abrasive is repeatedly used for polishing as it is, uniformity of the polishing surface is gradually lost, causing an adverse effect on polishing performance. Further, there is a case where the surface layer of the fixed abrasive is scraped off by mechanical dressing, and scrapings are left on the surface of the fixed abrasive. There is also a case where, when a film on the surface to be polished of a substrate is removed by polishing, the removed film remains on the fixed abrasive.

The polishing apparatus 202 also has the waste matter removing device 32 (see FIG. 2), which has been described in connection with the first embodiment. Examples of the waste matter removing device 32 are a dresser, a waste matter removing mechanism having a nylon brush, an atomizer, an ultrasonic wave generator, a vacuum suction device, and the like as will be described later.

Figure 4:
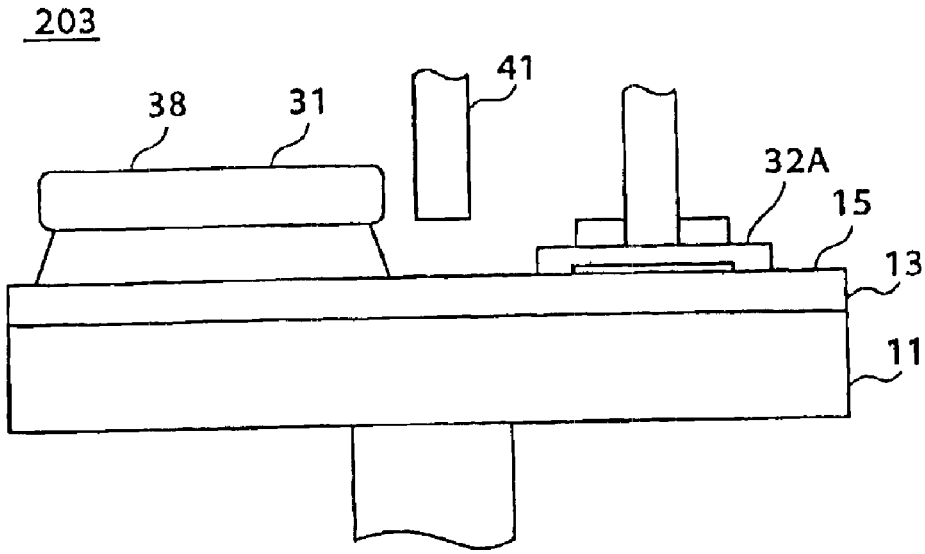
FIG. 4 is a schematic front view of a polishing apparatus according to a third embodiment of the present invention.

FIG. 4 shows a polishing apparatus 203 having a dresser 32A including diamond particles as a waste matter removing device according to a third embodiment of the present invention. The polishing apparatus 203 includes a dressing mechanism 38 having a light source 31 to perform dressing by light irradiation. In the polishing apparatus 203, waste matter unrelated to polishing, including the above-described incompletely dissolved resin, can be scraped off or eliminated by pressing the dresser 32A against polishing surface 15 of fixed abrasive 13. Thus, polishing abrasive particles can be exposed even more effectively, and hence efficient polishing can be realized. Further, if the incompletely dissolved resin is scraped off, a surface condition that is at least homogeneous can be reproduced on the polishing surface 15. Thus, it is possible to maintain a uniform surface condition.

Figure 5:
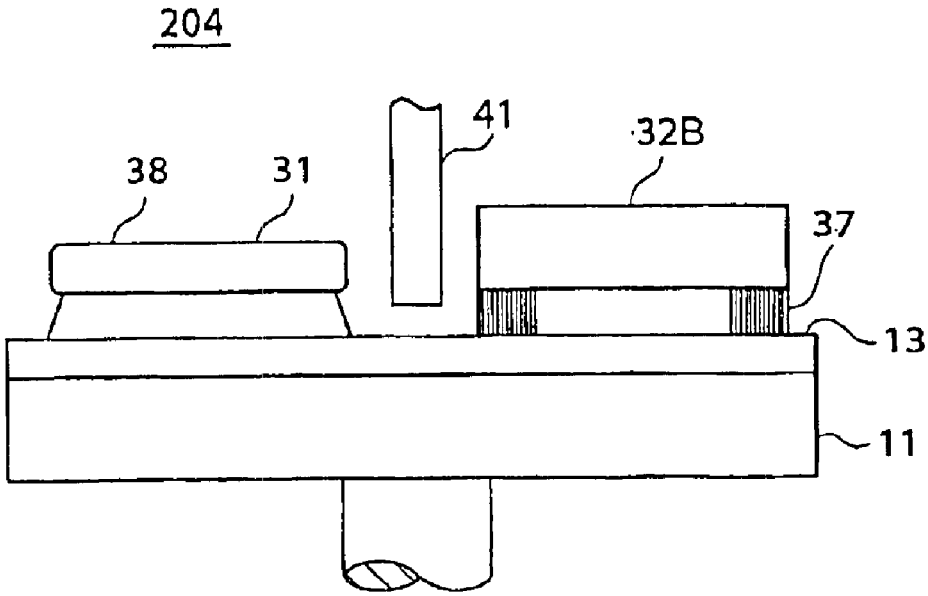
FIG. 5 is a schematic front view of a polishing apparatus according to a fourth embodiment of the present invention.

FIG. 5 is a schematic elevational view showing a polishing apparatus 204 including a waste matter removing device 32B having a nylon brush 37 according to a fourth embodiment of the present invention. The polishing apparatus 204 includes an optical dressing mechanism 38 having a light source 31. In the polishing apparatus 204, waste matter unrelated to polishing, including the above-described incompletely dissolved resin, can be scraped off or eliminated by pressing and rubbing the nylon brush 37 against polishing surface 15 of fixed abrasive 13. Thus, polishing abrasive particles can be exposed even more effectively, and hence efficient polishing can be realized. Further, if the incompletely dissolved resin is scraped off, a surface condition that is at least homogeneous can be reproduced on the polishing surface 15. Thus, it is possible to maintain a uniform surface condition.

The waste matter removing device 32B can be controlled independently of the optical dressing mechanism 38 that performs irradiation with light from the light source 31. It is also possible to control brushing power of the nylon brush 37 by varying a diameter and/or number of bristles of the nylon brush 37. If a nylon brush 37 made of fine bristles is used, for example, although polishing abrasive particles can remain on a surface of the fixed abrasive without being brushed off by the nylon brush 37 because the abrasive particles are much smaller (not more than 0.2 $\mu$m) than the bristles of the nylon brush 37, polishing products and the like, which are much larger than the abrasive particles, are caught by the bristles of the nylon brush 37 and thus selectively brushed off. The nylon brush 37 comprises a plurality of circular bundles (with a diameter of 3 to 5 mm) of bristles made of a general nylon material, for example, nylon 66 or Toray Model No. 200T-0.132 (available from Toray Industries, Inc.) and each having a diameter of 0.05 to 1.0 mm, a length of 5 to 10 mm and a circular sectional configuration. Alternatively, the nylon brush 37 is made of such nylon bristles disposed uniformly over an entire surface of the waste matter removing device 32B. From a practical point of view, it is particularly preferable to use a brush having fine bristles like general toothbrushes. Further, it is preferable to operate the nylon brush 37 under a low pressure.

Figure 6:
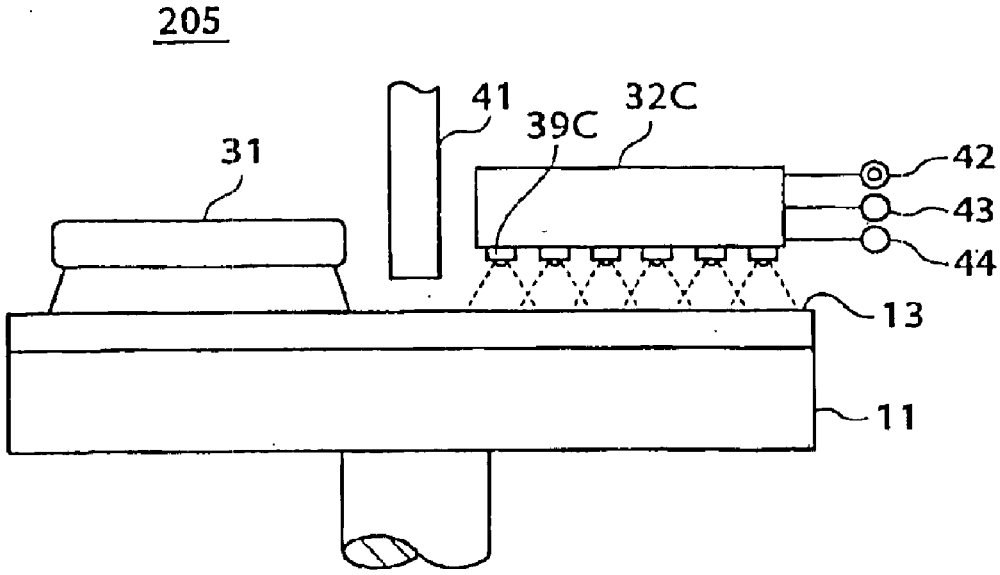
FIG. 6 is a schematic front view of a polishing apparatus according to a fifth embodiment of the present invention.

FIG. 6 shows a polishing apparatus 205 having an atomizer 32C according to a fifth embodiment of the present invention. The atomizer 32C functions as a second-liquid supply device for spraying $N_2$ gas and a second liquid or a second chemical liquid (pure water or a chemical liquid other than pure water) as a liquid in the form of mist. Instead of spraying $N_2$ gas and the second chemical liquid for removing waste matter, the atomizer 32C may be arranged to spray $N_2$ gas for removing waste matter and a first chemical liquid (different from the second chemical liquid for removing waste matter) for dressing by light irradiation. In this case, the atomizer 32C also functions as the first-liquid supply device in the present invention.

The atomizer 32C may be arranged as follows. To remove waste matter, the atomizer 32C supplies both $N_2$ gas and the second chemical liquid. To perform dressing by light irradiation, the atomizer 32C supplies the first chemical liquid (different from the second chemical liquid for removing waste matter) for use in dressing. In this case, the atomizer 32C also functions as the first-liquid supply device in the present invention.

The atomizer 32C can supply a fluid from each spray nozzle 39C, at a distal end of the atomizer 32C, at a uniform fluid flow rate and a uniform concentration distribution. By making use of this characteristic feature, for example, a photoinitiator (photosensitizer) as the first chemical liquid, which is used to improve a dressing action obtained by light irradiation as stated above, may be sprayed onto fixed abrasive 13. If uniform light irradiation can be realized when the photoinitiator is sprayed, it is possible to process the fixed abrasive 13 so that a uniform surface condition is obtained. In this case, the atomizer 32C is connected to a first-chemical liquid supply source 44 for supplying the photoinitiator. Thus, the atomizer 32C also functions as the first-liquid supply device in the present invention.

Further, the atomizer 32C is connected to a gas supply source 42 and a second-chemical liquid supply source 43. The atomizer 32C can realize any spray form, from mist spray to particulate spray, by changing pressure of a purge gas ($N_2$ gas, and the like) supplied from the gas supply source 42 and a flow rate and pressure of a second chemical liquid supplied from the second-chemical liquid supply source 43. Further, because the gas and liquid are applied in the form of a spray under the purge pressure, uniform application can be realized irrespective of a particle diameter. Because a plurality of fluids are used, it is possible to change concentration of a supplied fluid mixture. Thus, a surface of the fixed abrasive 13 can be finished to a polishing surface having fine asperities after light irradiation by varying a concentration distribution of the spray applied to the fixed abrasive 13, depending on the particle diameter and distribution of the liquid. Roughness of the asperities can be controlled by varying a degree of spraying. Thus, the asperities on the surface of the fixed abrasive 13 can be changed according to a kind of film formed on a substrate to be polished. For example, in a case of mist spray, the surface of the fixed abrasive 13 is finished to a surface condition with or without fine asperities. In a case of particulate spray, the surface of the fixed abrasive 13 is finished to a surface condition with relatively wavy asperities. Thus, it is possible to realize polishing for each particular purpose.

This arrangement may be as follows. The spray nozzles 39C of the atomizer 32C are supplied with fluid independently of each other, and each spray nozzle 39C is provided with a flow control mechanism (not shown) and a pressure control mechanism (not shown), thereby varying an amount of fluid sprayed from each spray nozzle 39C. With this arrangement, it is possible to vary a concentration distribution in a radial direction of the fixed abrasive 13 and hence possible to vary a profile in the radial direction after light irradiation. Accordingly, it is possible to selectively polish only a portion of substrate W (see FIG. 1) that is desired to be polished according to a profile of a finished surface of the fixed abrasive 13.

The polishing apparatus 205 may have a liquid spray (not shown) as a substitute for the atomizer 32C. The liquid spray has a plurality of spray nozzles (not shown) arranged in a row to face the polishing surface 15 of the fixed abrasive 13. From each spray nozzle, pure water from a pure water supply source is supplied onto the polishing surface 15 at a uniform liquid flow rate and with a uniform concentration distribution under a high pressure (e.g. 5 MPa or more) controlled by a pressure control mechanism (not shown). Thus, waste matter such as scrapings can be removed and washed away. The polishing apparatus 205 may also have a gas spray for spraying a gas onto the fixed abrasive 13 to remove waste matter by gas pressure as a substitute for the liquid spray.

It is also possible to dissolve and remove the above-described resin unrelated to polishing by using a second chemical liquid different from the first chemical liquid used during dressing by light irradiation, depending upon the kind of resin used for the fixed abrasive 13. As the second chemical liquid, an oxidizing agent or the like exhibiting an oxidatively decomposing action is also usable. It should be noted that use of the atomizer 32C allows the second chemical liquid to be sprayed onto the polishing surface 15 of the fixed abrasive 13 uniformly and hence enables uniform optical dressing. It should be noted that the above-described liquid spray may be used in place of the atomizer 32C.

Figure 7:
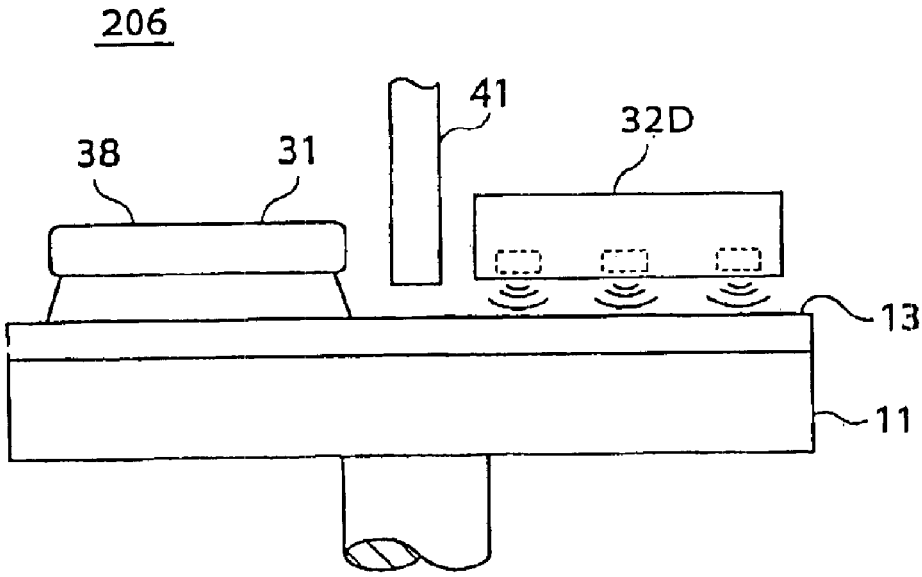
FIG. 7 is a schematic front view of a polishing apparatus according to a sixth embodiment of the present invention.

FIG. 7 shows a polishing apparatus 206 adapted to remove waste matter by ultrasonic vibrations according to a sixth embodiment of the present invention. The polishing apparatus 206 has an ultrasonic wave generator 32D. The ultrasonic wave generator 32D is usually disposed directly above fixed abrasive 13. Pure water is interposed between the ultrasonic wave generator 32D and the fixed abrasive 13. Consequently, ultrasonic waves generated from the ultrasonic wave generator 32D are transmitted to polishing surface 15 of the fixed abrasive 13 through the pure water. Thus, waste matter remaining on the polishing surface 15 of the fixed abrasive 13 can be removed by the ultrasonic vibrations. It should be noted that the polishing apparatus 206 has an optical dressing mechanism 38 for performing dressing by light irradiation. The ultrasonic wave generator 32D can be controlled independently of the optical dressing mechanism 38. Waste matter removing power can be varied by controlling an ultrasonic wave output and a distance to the fixed abrasive 13. In a case where resin used in the fixed abrasive 13 is very brittle (i.e. its glass transition temperature is low), ultrasonic wave action alone allows free abrasive particles to be generated from the fixed abrasive. In this case, it is possible to supply a chemical liquid besides pure water or a mixture thereof as a liquid interposed between the ultrasonic wave generator 32D and the fixed abrasive 13 to transmit ultrasonic waves.

Figure 8:
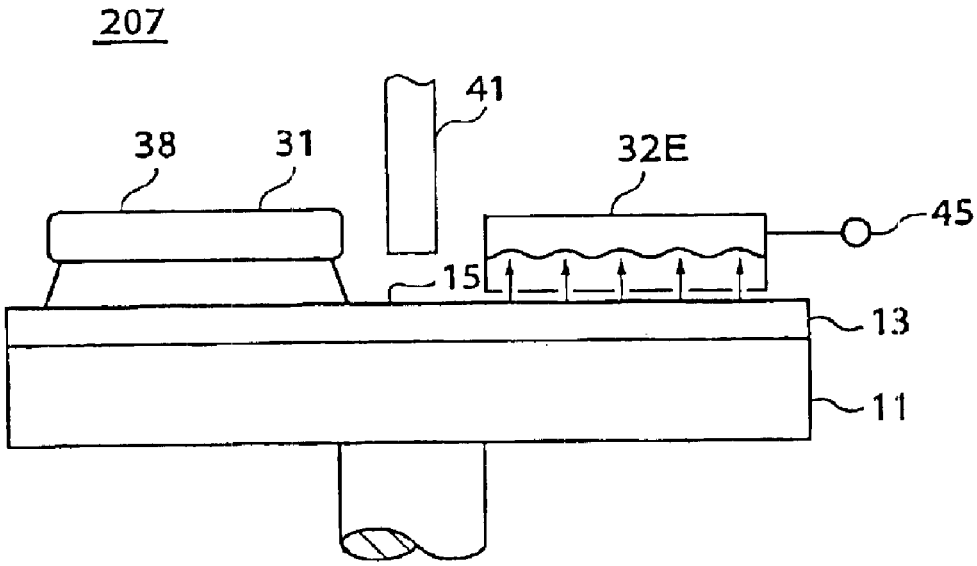
FIG. 8 is a schematic front view of a polishing apparatus according to a seventh embodiment of the present invention.

FIG. 8 shows a polishing apparatus 207 adapted to remove waste matter by vacuum suction according to a seventh embodiment of the present invention. The polishing apparatus 207 has a vacuum suction device 32E connected to a vacuum supply source 45. The vacuum suction device 32E is usually disposed directly above the fixed abrasive 13. It should be noted that the polishing apparatus 207 includes an optical dressing mechanism 38 having a light source 31. The vacuum suction device 32E also sucks in the above-described waste matter unrelated to polishing and collects the waste matter through a drain (not shown) or a filter (not shown) provided between the vacuum supply source 45 and the vacuum suction device 32E.

Figure 9:
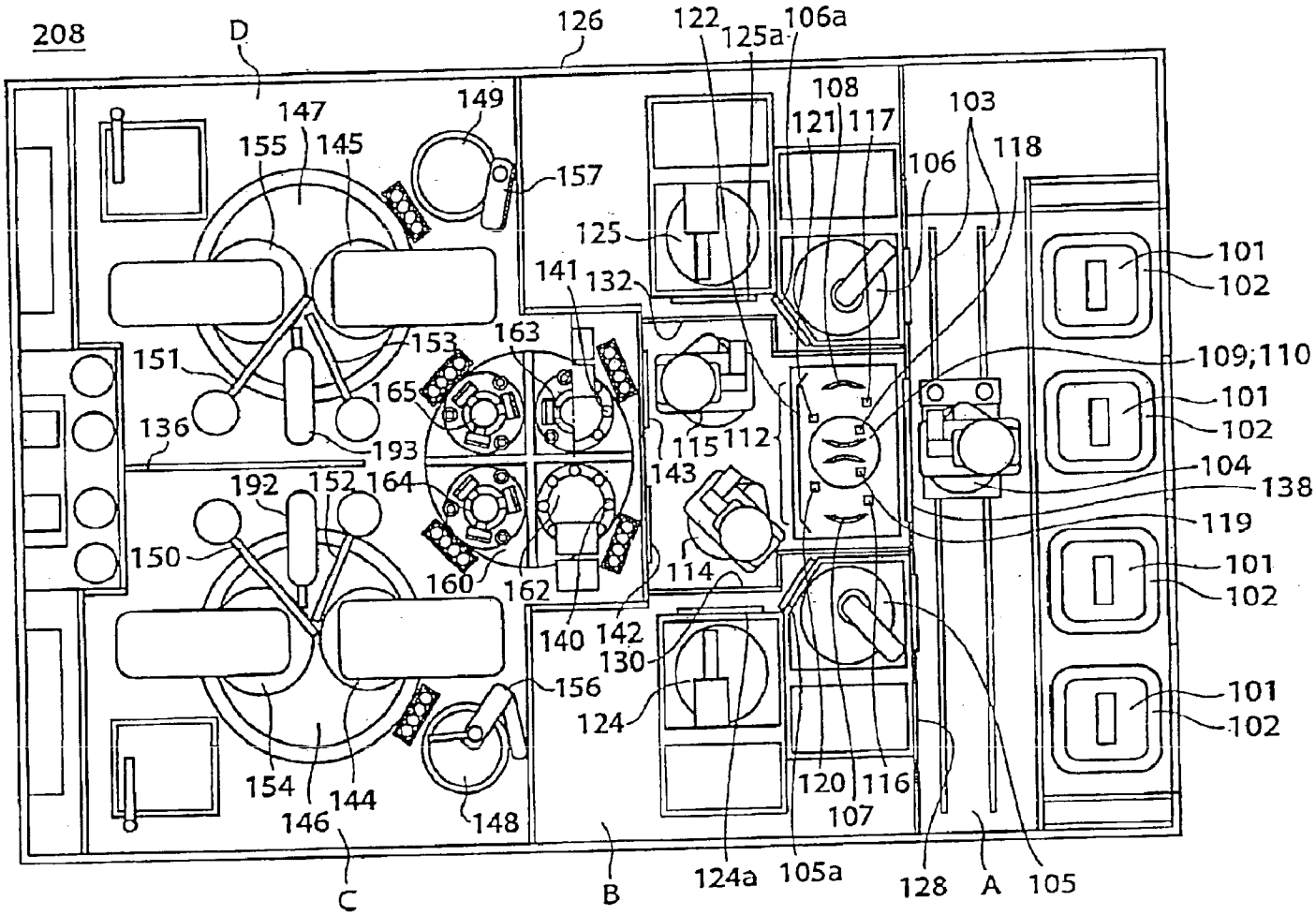
FIG. 9 is a plan view showing a general arrangement of a polishing system according to an embodiment of the present invention.

FIG. 9 is a plan view showing a general arrangement of a polishing system 208 according to an embodiment of the present invention. It should be noted that the polishing system 208 has the polishing apparatus according to the fifth embodiment. The polishing system 208 may use the polishing apparatus according to the first to fourth, sixth and seventh embodiments in place of the polishing apparatus according to the fifth embodiment. As shown in FIG. 9, the polishing system 208 has four loading/unloading stages 102 for placing thereon wafer cassettes 101 each stocked with a large number of semiconductor wafers W (see FIG. 1). The loading/unloading stages 102 may have a mechanism allowing each loading/unloading stage 102 to move vertically. A transfer robot 104 is disposed on a traveling mechanism 103 so as to be able to reach the wafer cassettes 101 on the loading/unloading stages 102.

The transfer robot 104 has two hands (upper and lower hands). Of the two hands of the transfer robot 104, the lower hand is a suction-hold hand for holding a semiconductor wafer W (see FIG. 1) under vacuum. The lower hand is used only when receiving a semiconductor wafer W from a wafer cassette 101. The suction-hold hand can transfer semiconductor wafer W accurately irrespective of possible displacement of the semiconductor wafers W in the wafer cassette 101. On the other hand, the upper hand of the transfer robot 104 is a drop-in hand for gripping a peripheral edge portion of a semiconductor wafer W. The upper hand is used only when returning a semiconductor wafer W to a wafer cassette 101. Unlike the suction-hold hand, the drop-in hand does not collect dust particles. Therefore, the drop-in hand can transfer a semiconductor wafer W while maintaining cleanliness of a reverse side of the wafer W. Thus, a clean wafer W after being cleaned is positioned at an upper side, thereby preventing the wafer W from being further contaminated.

Two cleaning machines 105 and 106 for cleaning semiconductor wafers W are disposed in an axial symmetrical relationship relative to the wafer cassettes 101 with respect to the traveling mechanism 103 for the transfer robot 104. The cleaning machines 105 and 106 are installed at respective positions within reach of the hands of the transfer robot 104. The cleaning machines 105 and 106 have a spin drying function of rotating wafers W at high speed to dry them. Thus, it is possible to realize two-stage cleaning and three-stage cleaning of wafers W without a need for module change.

Between the two cleaning machines 105 and 106, a wafer station 112 is disposed at a position within reach of the hands of the transfer robot 104. The wafer station 112 has four mount plates 107, 108, 109 and 110 for placing semiconductor wafers W thereon. A transfer robot 114 having two hands is disposed at a position where its hands can reach the cleaning machine 105 and three mount plates 107, 109 and 110. A transfer robot 115 having two hands is disposed at a position where its hands can reach the cleaning machine 106 and three mount plates 108, 109 and 110.

The mount plate 107 is used to deliver a semiconductor wafer W between the transfer robot 104 and the transfer robot 114. The mount plate 108 is used to transfer a semiconductor wafer W between the transfer robot 104 and the transfer robot 115. The mount plates 107 and 108 are provided with respective sensors 116 and 117 for detecting whether or not a semiconductor wafer W is present thereon.

The mount plate 109 is used to transfer a semiconductor wafer W from the transfer robot 115 to the transfer robot 114. The mount plate 110 is used to transfer a semiconductor wafer W from the transfer robot 114 to the transfer robot 115. The mount plates 109 and 110 are provided with respective sensors 118 and 119 for detecting whether or not a semiconductor wafer W is present thereon. Further, the mount plates 109 and 110 are provided with respective rinse nozzles 120 and 121 for preventing semiconductor wafers W from drying or for cleaning them.

The mount plates 109 and 110 are disposed in a mutual waterproof cover. The cover is provided with an opening for transfer. A shutter 122 is provided at this transfer opening of the cover. The mount plate 109 is positioned vertically above the mount plate 110. A wafer W after cleaning is placed on the mount plate 109. A wafer W before cleaning is placed on the mount plate 110. With this arrangement, wafers W are prevented from being contaminated by dropping rinsing water thereonto. It should be noted that the sensors 116, 117, 118 and 119, the rinse nozzles 120 and 121 and the shutter 122 in FIG. 9 are schematically shown, and positions and configurations of these members are not accurately illustrated.

A cleaning machine 124 is disposed at a position within reach of the hands of the transfer robot 114 in such a manner as to be adjacent to the cleaning machine 105. Further, a cleaning machine 125 is disposed at a position within reach of the hands of the transfer robot 115 in such a manner as to be adjacent to the cleaning machine 106. The cleaning machines 124 and 125 are capable of cleaning both sides of wafers W.

Upper hands of the transfer robots 114 and 115 are used to transfer a semiconductor wafer W once cleaned to a cleaning machine or to a mount table of the wafer station 112. Lower hands of the transfer robots 114 and 115 are used to transfer a semiconductor wafer W that has never been cleaned and a semiconductor wafer W before being polished. Use of the lower hands of the transfer robots 114 and 115 to perform loading and unloading of wafers W into and from a turning-over machine 140 (described later) prevents the upper hands thereof from being contaminated by droplets of rinsing water from a top wall of the turning-over machine 140.

The cleaning machines 105, 106, 124 and 125 have shutters 105*a*, 106*a*, 124*a* and 125*a* installed at respective wafer W loading openings, as shown in FIG. 9. The shutters 105*a*, 106*a*, 124*a* and 125*a* are openable only when wafers W are loaded into the cleaning machines 105, 106, 124 and 125.

The polishing system 208 has a housing 126 installed to surround its equipment. An interior of the housing 126 is divided into a plurality of areas (including area A and area B) by partitions 128, 130, 132, 134 and 136.

In area A, the wafer cassettes 101 and the transfer robot 104 are disposed. In area B, the cleaning machines 105 and 106 and the mount plates 107, 108, 109 and 110 are disposed. Between areas A and B, the partition 128 is disposed to divide areas A and B from each other in terms of degree of cleanliness. The partition 128 is provided with an opening for transferring a semiconductor wafer W between areas A and B. The opening is provided with a shutter 138. The cleaning machines 105, 106, 124 and 125, the mount plates 107, 108, 109 and 110 of the wafer station 112 and the transfer robots 114 and 115 are all disposed in area B. Atmospheric pressure in area B is adjusted to be lower than atmospheric pressure in area A.

As shown in FIG. 9, turning-over machine 140 for turning over a semiconductor wafer W is installed in area C divided from area B by the partition 134. The turning-over machine 140 is disposed at a position within reach of the hands of the transfer robot 114. The transfer robot 114 transfers a semiconductor wafer W to the turning-over machine 140. Further, in area C, a turning-over machine 141 for turning over a semiconductor wafer W is disposed at a position within reach of the hands of the transfer robot 115. The transfer robot 115 transfers a semiconductor wafer W to the turning-over machine 141. The turning-over machines 140 and 141 each have a chuck mechanism for chucking a semiconductor wafer W, a turning-over mechanism for turning over a semiconductor wafer W, and a sensor (not shown) for checking whether or not a semiconductor wafer W is chucked by the chuck mechanism.

A polishing chamber is divided from area B by the partition 134. The polishing chamber is further divided into two areas C and D by the partition 136. It should be noted that the partition 134 for dividing area B from areas C and D is provided with openings for transferring semiconductor wafers W. The openings are provided with respective shutters 142 and 143 for the turning-over machines 140 and 141.

As shown in FIG. 9, the two areas C and D contain respective turntables 146 and 147 and respective turntables 148 and 149. Further, top rings 144 and 145 are disposed in areas C and D, respectively. The top rings 144 and 145 each hold a single semiconductor wafer and press these respective semiconductor wafers against the turntables 147 and 148 to polish them.

More specifically, the following devices are disposed in area C: top ring 144; turntables 146 and 148; a polishing solution supply nozzle 150 for supplying a polishing solution onto the turntable 146; an atomizer 152 having a plurality of spray nozzles (not shown) connected to a nitrogen gas supply source (not shown) and a second-chemical liquid supply source (not shown); a dresser 154 for performing mechanical dressing on the turntable 146; and a dresser 156 for performing mechanical dressing on the turntable 148.

Similarly, the following devices are disposed in area D: top ring 145; turntables 147 and 149; a polishing solution supply nozzle 151 for supplying a polishing solution onto the turntable 147; an atomizer 153 having a plurality of spray nozzles (not shown) connected to a nitrogen gas supply source (not shown) and a second-chemical liquid supply source (not shown); a dresser 155 for performing mechanical dressing on the turntable 147; and a dresser 157 for performing mechanical dressing on the turntable 149.

The polishing solution supply nozzles 150 and 151 supply a polishing solution for use during polishing and a dressing liquid (e.g. water) for use during mechanical dressing onto the turntables 146 and 147, respectively. The atomizers 152 and 153 spray a fluid mixture of nitrogen gas and a second chemical liquid (pure water or a chemical liquid other than pure water) onto the turntables 146 and 147, respectively. Nitrogen gas from the nitrogen gas supply source and the second chemical liquid from the second-chemical liquid supply source are adjusted to a predetermined pressure, through a regulator (not shown) and an air operator valve (not shown), and mixed together before being supplied to spray nozzles (not shown) of the atomizers 152 and 153. In this case, the spray nozzles of the atomizers 152 and 153 are preferably arranged to spray fluid toward respective outer peripheries of the turntables 146 and 147. It should be noted that nitrogen gas may be replaced with other inert gas. It is also possible to spray only the second chemical liquid from the atomizers 152 and 153. It should be noted that the turntables 148 and 149 may also be provided with atomizers. If the turntables 148 and 149 are provided with atomizers, surfaces of the turntables 148 and 149 can be maintained even cleaner. The mixture of nitrogen gas and the second chemical liquid (pure water or a chemical liquid other than pure water) is sprayed from the spray nozzles of the atomizers 152 and 153 toward the turntables 146 and 147 in the form of ① fine liquid particles or ② fine solid particles of a solidified liquid or ③ gas resulting from evaporation of the liquid (a process of obtaining ①, ② or ③ is referred to as "atomization"). The form in which the mixture of fluids is sprayed, i.e. fine liquid particles, or fine solid particles or gas, is determined by pressure and temperature of the nitrogen gas and/or the second chemical liquid (pure water or a chemical liquid other than pure water) or a nozzle configuration, and the like. Accordingly, the form in which the fluid mixture is sprayed can be changed by appropriately changing pressure and temperature of the nitrogen gas and/or the second chemical liquid (pure water or a chemical liquid other than pure water) with a regulator or the like or properly changing a nozzle configuration, and the like.

It should be noted that the turntables 148 and 149 may be replaced with wet-type wafer film thickness measuring devices, respectively. In such a case, it is possible to measure a film thickness of a wafer W immediately after it has been polished and hence possible to perform additional polishing of the wafer W. It is also possible to control a polishing process for a subsequent wafer W by utilizing this measured value.

A rotary transporter 160 is disposed below the turning-over machines 140 and 141 and the top rings 144 and 145 to transfer wafers W between the cleaning chamber (area B) and the polishing chamber (areas C and D). The rotary transporter 160 is provided with four stages for placing wafers W thereon. The stages are disposed at four equally spaced positions, respectively. Thus, a plurality of wafers W can be simultaneously mounted on the rotary transporter 160.

Wafers W transferred to the turning-over machines 140 and 141 are transferred onto the rotary transporter 160 through lifters 162 and 163 installed below the rotary transporter 160. More specifically, when centers of the stages on the rotary transporter 160 are in phase with centers of wafers W chucked by the turning-over machines 140 and 141, the lifters 162 and 163 move vertically to transfer the wafers W onto the rotary transporter 160. The wafers W mounted on the stages of the rotary transporter 160 are transferred under the top rings 144 and 145 by changing a position of the rotary transporter 160 through 90°. The top rings 144 and 145 have pivotally moved to the position of the rotary transporter 160 in advance. When the centers of the top rings 144 and 145 are in phase with the centers of the wafers W mounted on the rotary transporter 160, pushers 164 and 165 move vertically, thereby allowing the wafers W to be transferred from the rotary transporter 160 to the top rings 144 and 145.

The polishing system 208 has optical dressing mechanisms 192 and 193 in areas C and D, respectively. The optical dressing mechanisms 192 and 193 have respective light sources 194 (see FIG. 11, described later), e.g. mercury-vapor lamps, for applying light rays to polishing surfaces 146B and 147B of fixed abrasives 146A and 147A. The optical dressing mechanisms 192 and 193 further have respective first-chemical liquid supply nozzles 196 (see FIG. 11, described later) as first-liquid supply devices for supplying a first chemical liquid as a first liquid onto the polishing surfaces 146B and 147B.

Figure 10:
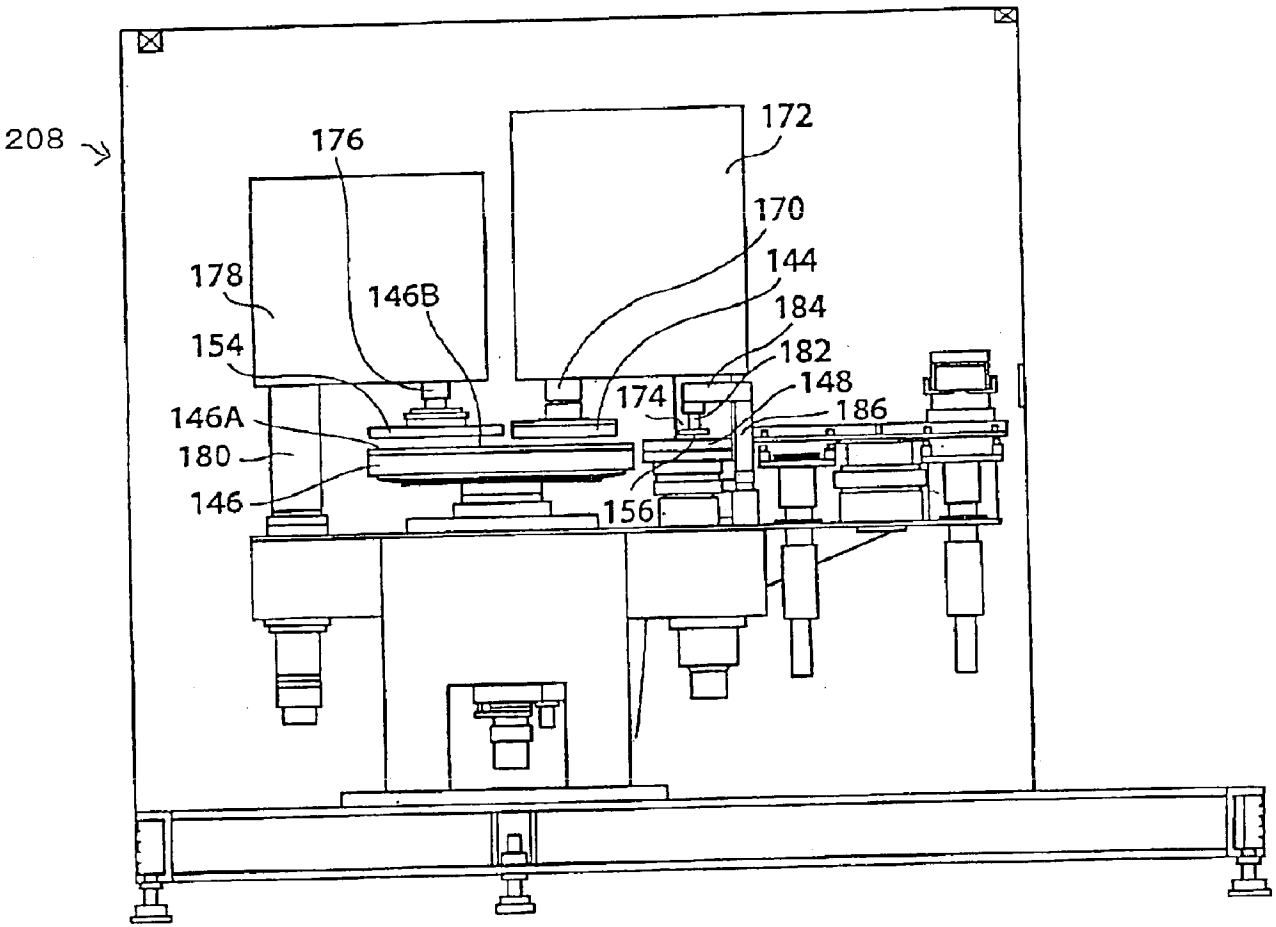
FIG. 10 is a front view of a polishing chamber (areas C and D in FIG. 9) of the polishing system shown in FIG. 9.

Next, the polishing chamber (areas C and D in FIG. 9) of the polishing system 208 will be described in more detail with reference to FIG. 10. It should be noted that the following description will be made of only area C. Area D can be regarded as similar to area C. FIG. 10 also shows a relationship between the top ring 144 and the turntables 146 and 148 in area C. As illustrated in FIG. 10, the top ring 144 is suspended from a top ring head 172 through a rotatable top ring driving shaft 170. The top ring head 172 is supported by a pivot shaft 174 capable of positioning. Thus, the top ring 144 can access both the turntables 146 and 148.

The dresser 154 is suspended from a dresser head 178 through a rotatable dresser driving shaft 176. The dresser head 178 is supported by a pivot shaft 180 capable of positioning. Thus, the dresser 154 is movable between a standby position for waiting and a dressing position over the turntable 146 for performing mechanical dressing. Similarly, the dresser 156 is suspended from a dresser head 184 through a rotatable dresser driving shaft 182. The dresser head 184 is supported by a pivot shaft 186 capable of positioning. Thus, the dresser 156 is movable between a standby position for waiting and a dressing position over the turntable 148 for performing mechanical dressing.

A top surface of the turntable 146 is formed from a fixed abrasive 146A comprising abrasive particles and pores or a pore-forming agent, which are bonded together by a binder (predetermined resin). The fixed abrasive 146A constitutes a polishing surface 146B for polishing a semiconductor wafer W (see FIG. 1) held by the top ring 144. The fixed abrasive 146A is obtained, for example, by spraying and drying a mixed solution formed by dispersing and mixing together a slurry-like abrasive (prepared by dispersing abrasive particles in a liquid) and an emulsion-like resin, and filling this resulting mixed powder into a molding jig, and then subjecting the mixed powder to pressurizing and heating treatment. As the abrasive particles, it is preferable to use ceria ($CeO_2$) or silica ($SiO_2$) having an average particle diameter of not more than 0.5 $\mu$m. As the binder, it is possible to use thermoplastic resins and thermosetting resins as stated above. It is particularly preferable to use a thermoplastic resin.

A top surface of the turntable 148 is formed from a non-rigid nonwoven fabric (not shown). The nonwoven fabric constitutes a cleaning surface for cleaning a surface of a semiconductor wafer W after polishing to remove abrasive particles adhering to this wafer surface.

A semiconductor wafer W polished with the fixed abrasive 146A as stated above is moved to the turntable 148, which has a small diameter, and subjected to buff cleaning on the turntable 148. That is, the top ring 144 and the turntable 148 are rotated independently of each other, and while doing so, this polished semiconductor wafer W held by the top ring 144 is pressed against the non-rigid nonwoven fabric on the turntable 148. At this time, a liquid not containing abrasive particles, e.g. pure water or an alkali solution, preferably an alkali solution having a pH of 9 or more, or an alkali solution containing TMAH, is supplied to the nonwoven fabric from a cleaning liquid supply nozzle (not shown). By doing so, abrasive particles adhering to the surface of the polished semiconductor wafer W can be removed effectively.

Figure 11:
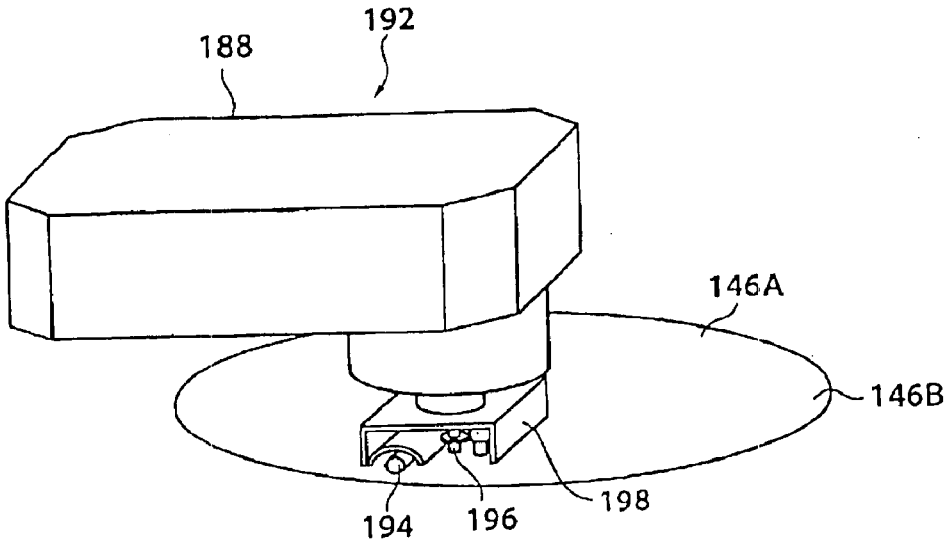
FIG. 11 is a perspective view of an optical dressing mechanism of the polishing system shown in FIG. 9.

FIG. 11 is a perspective view showing a general arrangement of an optical dressing mechanism 192 for performing dressing by light irradiation. The optical dressing mechanism 192 has an optical dresser unit 198 and a driving arm 188. The optical dresser unit 198 includes a light source lamp 194 for applying light to polishing surface 146B of fixed abrasive 146A, and a first-chemical liquid supply nozzle 196 for supplying a first chemical liquid onto the polishing surface 146B. The optical dresser unit 198 is connected and secured to the driving arm 188 through a cylinder (not shown) for vertical movement. The optical dresser unit 198 is moved vertically by action of the cylinder for vertical movement to adjust a gap between the light source lamp 194 and the polishing surface 146B of the fixed abrasive 146A, which is to be optically dressed. The driving arm 188 pivotally moves within a horizontal plane to perform positioning of the optical dresser unit 198 over the polishing surface 146B of the fixed abrasive 146A, which is to be optically dressed.

Figure 12:
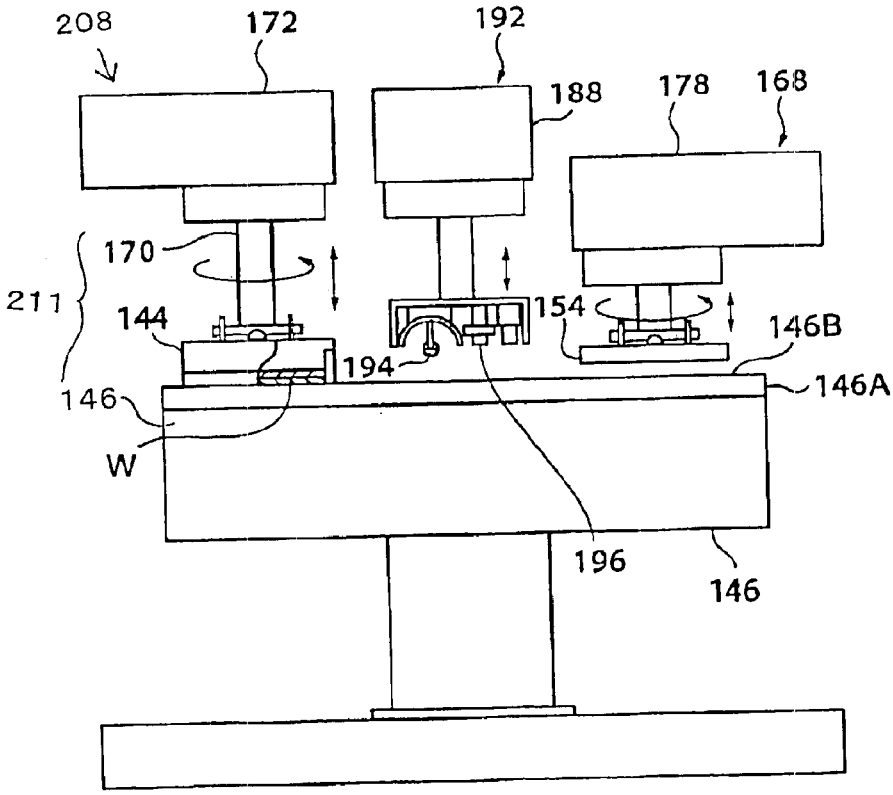
FIG. 12 is a front view of a turntable and its periphery in the polishing system shown in FIG. 9.

FIG. 12 is a front view of the turntable 146 and its periphery in the polishing system 208 according to the present invention. The turntable 146 has the fixed abrasive 146A as a polishing tool. A semiconductor wafer W to be polished, that is held by the top ring 144, is pressed against the polishing surface 146B of the fixed abrasive 146A through pivotal movement of the top ring head 172 about the pivot shaft 170 and through downward movement of the top ring head 172 caused by a cylinder (not shown) for vertical movement. In this state, the wafer W is rotated to slide on the polishing surface 146B of the fixed abrasive 146A. Thus, polishing of the semiconductor wafer W progresses.

Further, the polishing system 208 has a mechanical dressing mechanism 168 and an optical dressing mechanism 192. The mechanical dressing mechanism 168 has a dresser 154, e.g. a diamond dresser, which dresses the polishing surface 146B of the fixed abrasive 146A by mechanically contacting it. The optical dressing mechanism 192 has a light source 194, e.g. a mercury-vapor lamp, and a first-chemical liquid supply nozzle 196 to perform optical dressing by irradiation with light rays. In the polishing system 208, ordinary dressing is performed by irradiation with light rays using the optical dressing mechanism 192 before or during polishing of the wafer W. The mechanical dressing mechanism 168 is used to remove large irregularities formed on the fixed abrasive surface to make the polishing surface flat as a whole. In general, mechanical dressing is performed as occasion demands after a plurality of wafers W have been polished. Dressing by mechanical contact may be performed as follows. A degree of flatness of the polishing surface 146B of the fixed abrasive 146A is monitored by using a fixed abrasive surface measuring device (not shown), and when irregularities, for example, of 1 $\mu$m or more have been formed on the polishing surface 146B of the fixed abrasive 146A, the mechanical dressing is performed.

Next, a dressing method for the fixed abrasive as a polishing tool will be described. Regarding a timing for performing dressing, it may be performed at the same time as a substrate is polished (in-situ technique; this will hereinafter be referred to as "first technique"). It is also possible to perform dressing during a time interval between termination of polishing for one substrate and commencement of polishing for a subsequent substrate (ex-situ technique; this will hereinafter be referred to as "second technique"). When a conventional fixed abrasive is subjected to conditioning performed during the time interval between the termination of polishing for one substrate and the commencement of polishing for the subsequent substrate, a sufficient amount of free abrasive particles to serve for polishing the subsequent substrate cannot be generated from the fixed abrasive. Consequently, a polishing rate decreases with time. Thus, polishing stability cannot be obtained. For this reason, the prior art depends on the first technique (in-situ technique) whereby abrasive particles are constantly scraped out during polishing to stabilize supply of abrasive particles. The dressing by light irradiation according to the present invention also uses the first technique (in-situ technique) depending on the binder resin of the fixed abrasive for which the optical dressing is effected. That is, a sufficient amount of free abrasive particles cannot be ensured depending on the kind of binder resin used in the fixed abrasive. In such a case, the first technique (in-situ technique) is used. In a case where a fixed abrasive has to be placed on a turntable having almost the same diameter as a wafer diameter, e.g. a scroll type turntable, dressing cannot be performed during polishing. Therefore, only the second technique (ex-situ technique) is used for dressing.

FIGS. 13 to 17 are timing charts showing examples of an operational sequence of the polishing system 208 (see FIG. 9) according to the present invention. In each chart, the abscissa axis represents the passage of time T. The ordinate axis represents operating conditions of the dresser 154 (or 155), the top ring 144 (or 145), the optical dressing mechanism 192 (or 193) and the waste matter removing device 152 (or 153) (for these constituent elements, see FIG. 9). "OFF" shows suspension of operation. "ON" indicates that operation is in progress. In FIGS. 13 to 17, dressing by the dresser 154 is mechanical dressing of the polishing surface of the fixed abrasive. Dressing by the optical dressing mechanism 192 is optical dressing, wherein dressing effected by applying light to the polishing surface of the fixed abrasive is performed while the first chemical liquid is being supplied onto the polishing surface. Waste matter removal is effected by using the atomizer 152 as a waste matter removing device.

Figure 13:
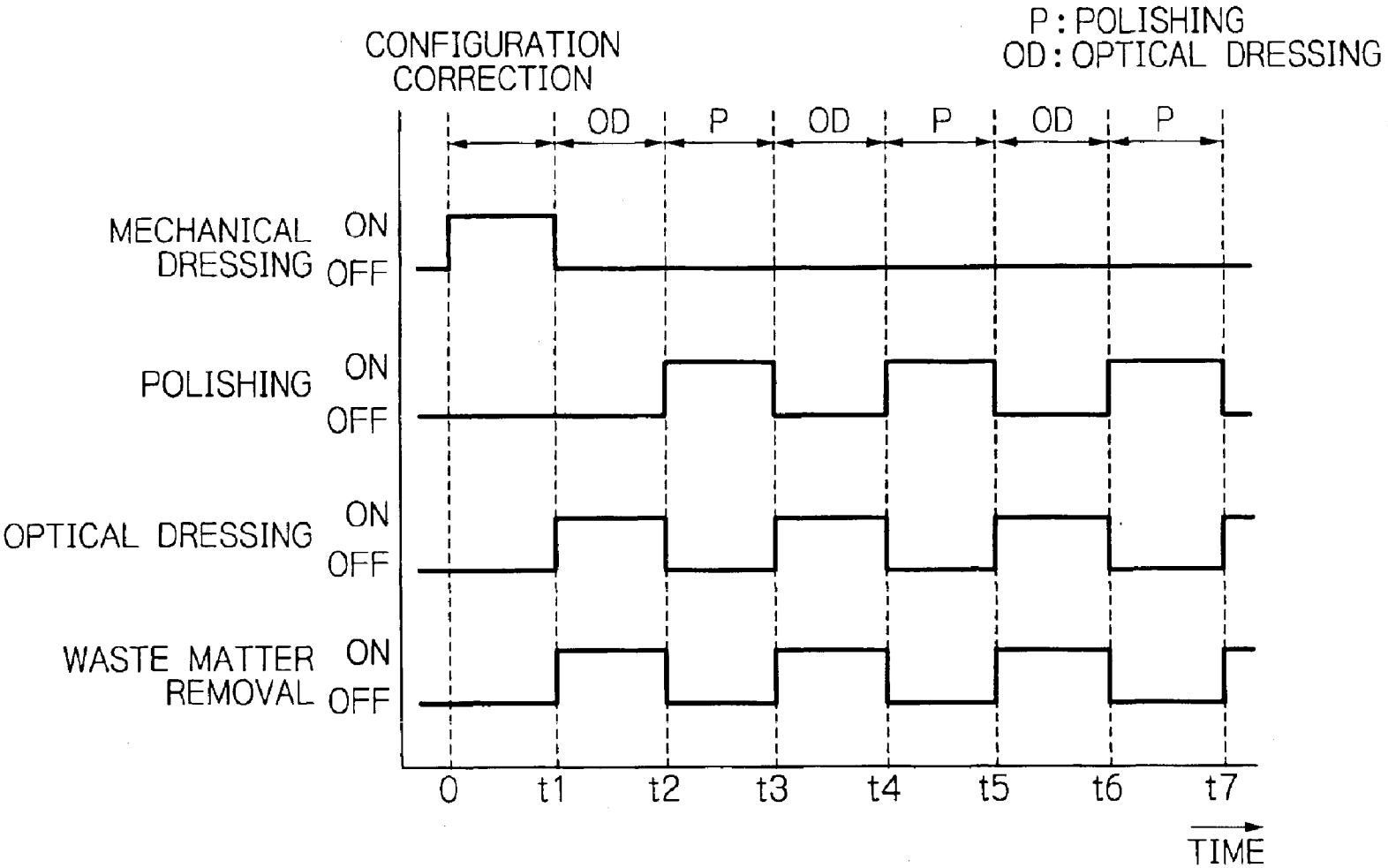
FIG. 13 is a timing chart showing an example of a series of dressing operations performed according to a second technique in the polishing system shown in FIG. 9.

FIG. 13 shows dressing according to the second technique (ex-situ technique). In this case, first, mechanical dressing for configuration correction by the dresser 154 (see FIG. 9) is performed (0 to t1). After completion of the mechanical dressing, the optical dressing by light irradiation is performed (t1 to t2). The optical dressing (OD) is performed intermittently (t1 to t2; t3 to t4; t5 to t6; . . . ) at regular intervals (t2–t1) (i.e. a light ray irradiation step in the present invention). At a point in time that the first optical dressing step has been completed (t2), polishing (P) of a semiconductor wafer held by the top ring 144 (see FIG. 9) is performed (i.e. a polishing step in the present invention). The polishing is intermittently performed (t2 to t3; t4 to t5; t6 to t7; . . . ) at regular intervals (t3–t2). The polishing is performed between one optical dressing step and a subsequent optical dressing step. Thus, optical dressing and polishing are alternately performed. Removal of waste matter by the atomizer 152 is performed at the same time as the optical dressing. That is, the waste matter removal is intermittently performed (t1 to t2; t3 to t4; t5 to t6; . . . ) at the same regular intervals (t2–t1) as for the optical dressing (the waste matter removal is a waste matter removing step in the present invention).

Figure 14:
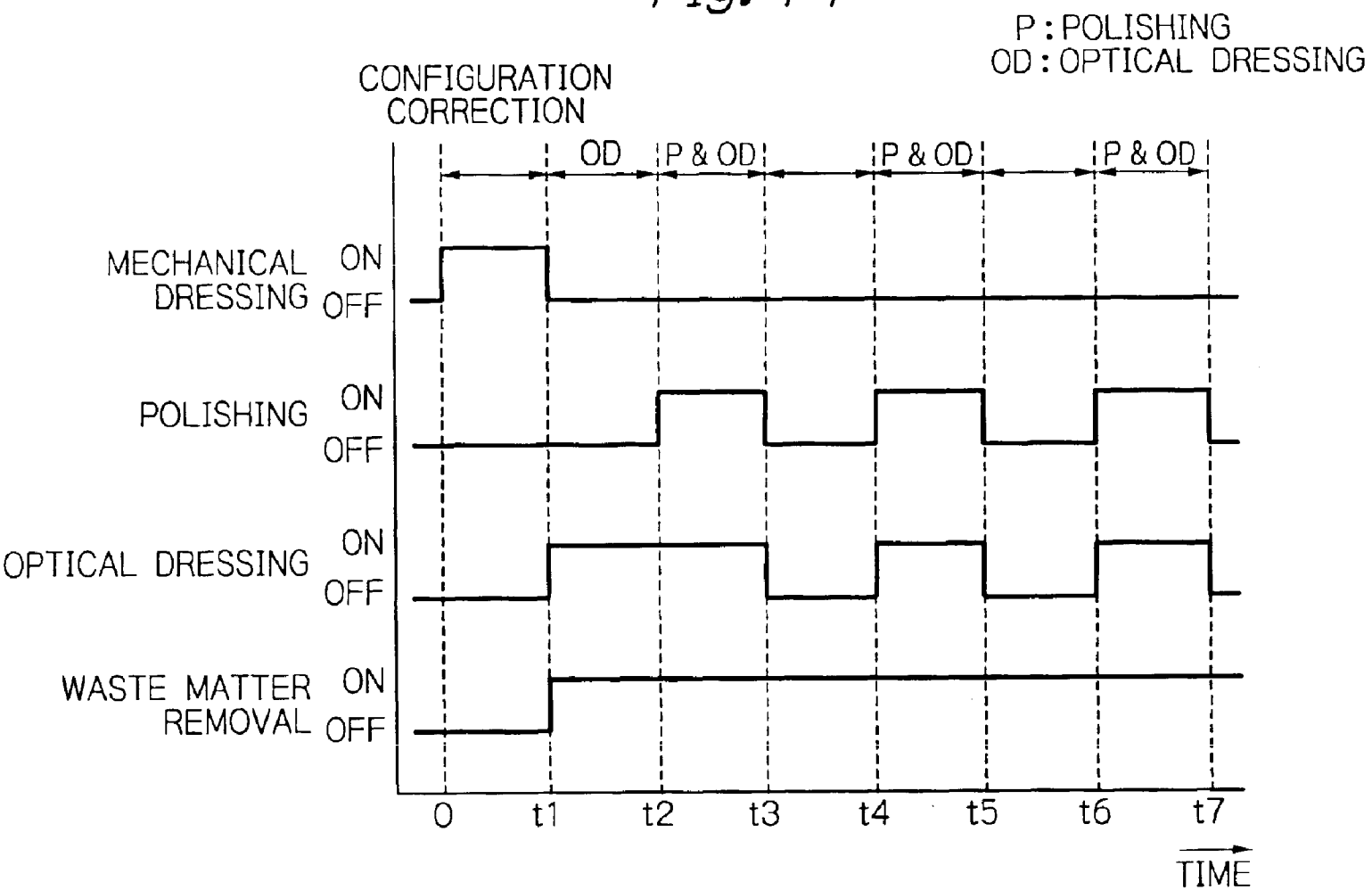
FIG. 14 is a timing chart showing an example of a series of dressing operations performed according to a first technique in the polishing system shown in FIG. 9.

FIG. 14 shows dressing according to the first technique (in-situ technique). In this case, first, mechanical dressing for configuration correction by the dresser 154 (see FIG. 9) is performed (0 to t1). After completion of the mechanical dressing, optical dressing by light irradiation before polishing is performed (t1 to t2) only for a predetermined interval of time (t2–t1) as pre-polishing optical dressing. After the predetermined interval of time (t2–t1) has elapsed, polishing is performed. The polishing is intermittently performed (t2 to t3; t4 to t5; t6 to t7; . . . ) at regular intervals (t3–t2). After elapse of the predetermined interval of time (t2–t1), the optical dressing is not suspended but continued for a predetermined interval of time (t3–t2) as it is. Thereafter, optical dressing is performed at the same time as polishing (t2 to t3; t4 to t5; t6 to t7; . . . ). In other words, after it has been performed for the first interval of time (t2–t1), the optical dressing is intermittently performed at the same regular intervals (t3–t2) as for the polishing. Waste matter removal is commenced at the same time (t1) as the optical dressing and continuously performed thereafter.

Figure 15:
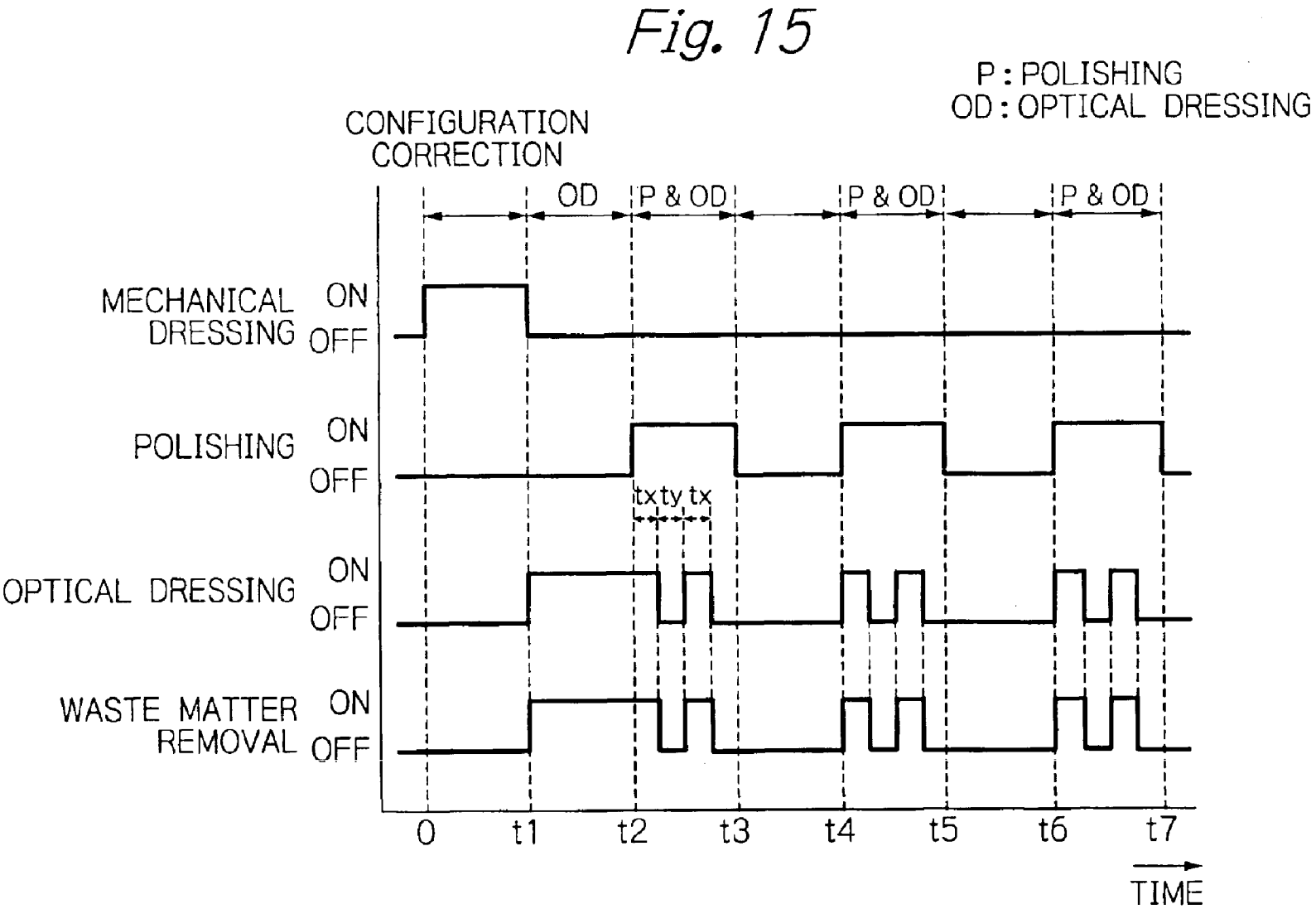
FIG. 15 is a timing chart showing an example of a series of dressing operations performed according to a third technique in the polishing system shown in FIG. 9.

FIG. 15 shows dressing according to a third technique (in-situ intermittent dressing technique). The third technique comprises the first technique (in-situ technique; FIG. 14) and the following intermittent dressing added thereto. The following description will be made mainly on points in which the third technique differs from the first technique shown in FIG. 14. Optical dressing by light irradiation is performed as pre-polishing optical dressing (t1 to t2) first. Thereafter, an intermittent optical dressing operation with a duration tx is performed twice with a suspension time ty between these two intermittent operations. The intermittent optical dressing is repeated with a predetermined period of time (t4–t2). The time at which the intermittent optical dressing is commenced is the same as the time of commencing polishing by the top ring 144 (see FIG. 9). A waste matter removing operation is performed at the same time as the optical dressing. Mechanical dressing and polishing are performed in the same way as in FIG. 14.

Figure 16:
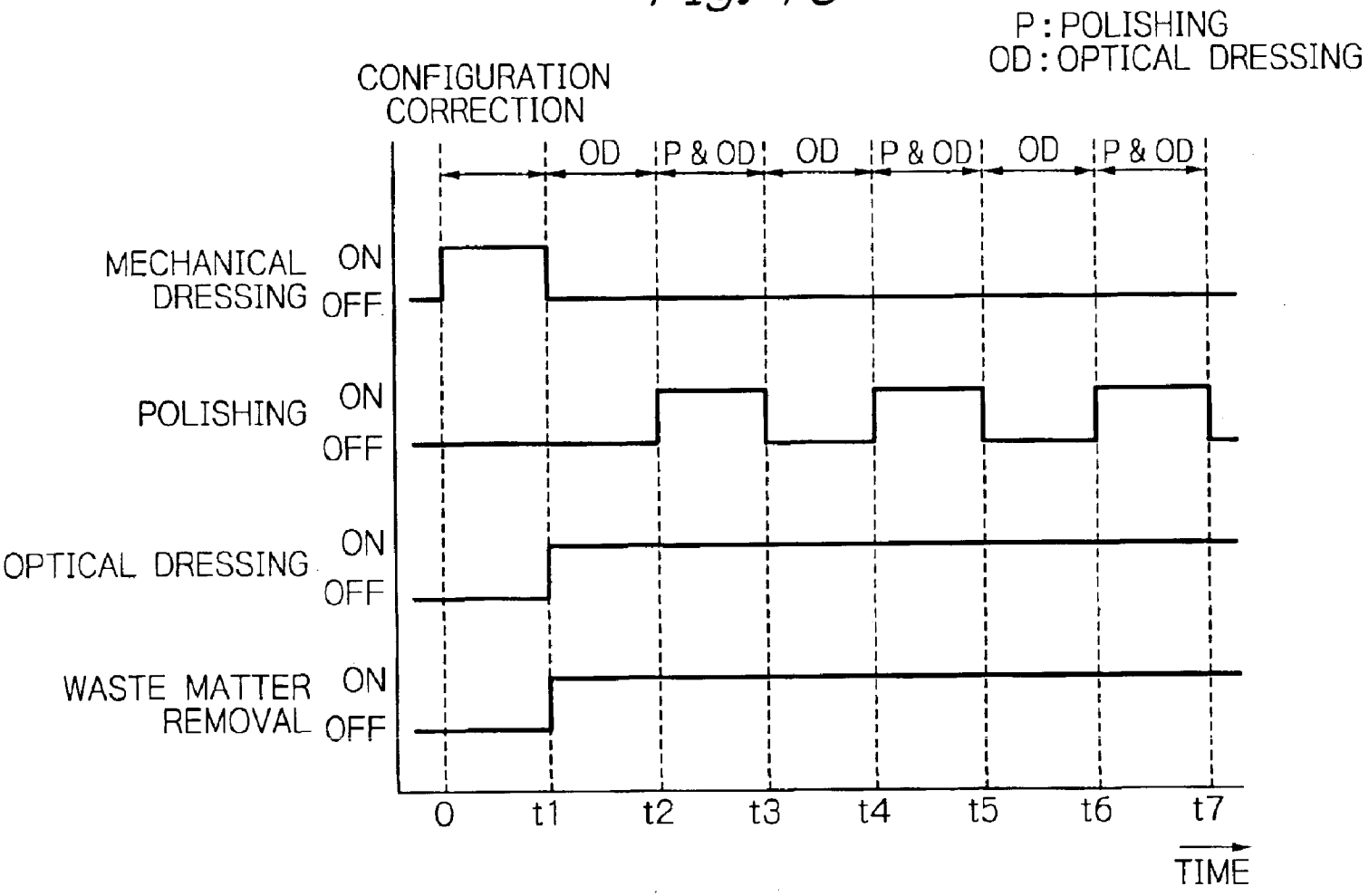
FIG. 16 is a timing chart showing an example of a series of dressing operations performed according to a fourth technique in the polishing system shown in FIG. 9.

FIG. 16 shows dressing according to a fourth technique (continuous optical dressing). The following description will be made mainly on points in which the fourth technique differs from the first technique shown in FIG. 14. Optical dressing by light irradiation is performed for a predetermined period of time (t1 to t2) before polishing is commenced. Thereafter, the optical dressing is continuously performed as it is. In other words, while the polishing is performed, the optical dressing is performed. Further, the optical dressing is continued even when the polishing is interrupted. A waste matter removing operation is performed at the same time as the optical dressing. Mechanical dressing and polishing are performed in the same way as in FIG. 14.

Figure 17:
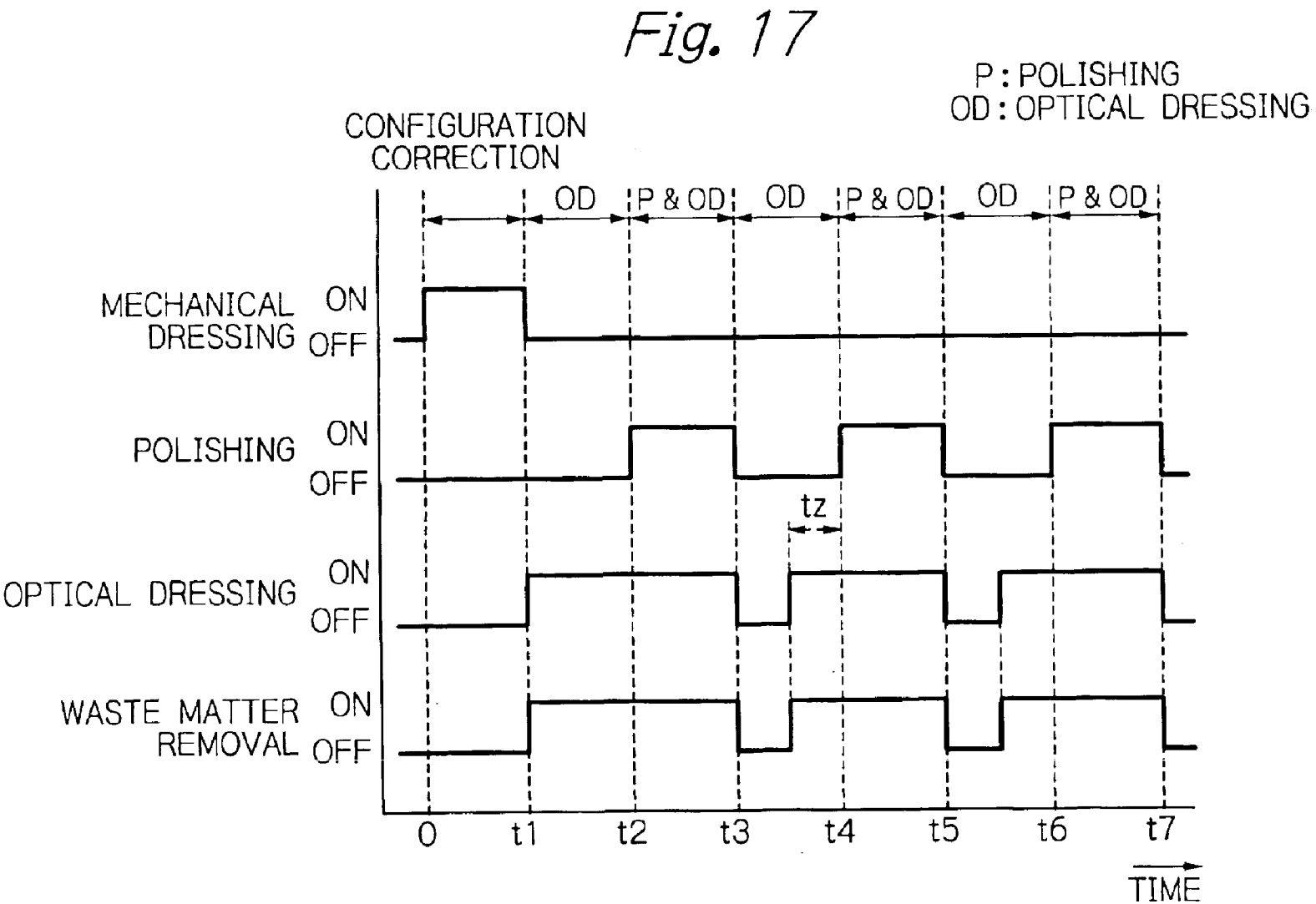
FIG. 17 is a timing chart showing an example of a series of dressing operations performed according to a fifth technique in the polishing system shown in FIG. 9.

FIG. 17 shows dressing according to a fifth technique (in-situ technique including optical dressing performed ahead of polishing). The technique shown in this figure is a technique developed from the first technique shown in FIG. 14. According to the first technique, polishing and optical dressing are performed at the same time at each polishing step. According to the fifth technique, an optical dressing commencing time is set a time tz ahead of a polishing commencing time so as to perform fore-optical dressing for a period of time tz ahead of each polishing treatment step. A waste matter removing operation is performed at the same time as optical dressing. Mechanical dressing and polishing are performed in the same way as in FIG. 14.

Advantageous effects of this technique are as follows. Prior to commencement of polishing, free abrasive particles are sufficiently generated from the fixed abrasive. Consequently, it is possible to perform polishing treatment with a predetermined polishing efficiency from the beginning of the polishing treatment without anxiety about start-up performance of polishing immediately after it has been commenced. As a result, it is possible to realize efficient and stable polishing.

When an effect of optical dressing by light irradiation is strong, the optical dressing may be performed only during the interval of time between termination of one polishing operation and commencement of a subsequent polishing operation or intermittently performed during each polishing operation. However, when an effect of optical dressing is weak, it is necessary to perform the optical dressing not only during each polishing operation but also during an interval of time between one polishing operation and a subsequent polishing operation. It is preferable to perform optical dressing continuously during a polishing process. The term "mechanical dressing" as used herein means dressing effected with a mechanical dresser (e.g. a diamond dresser, as stated above) that contributes mainly to configuration correction of a polishing surface. The term "optical dressing" means dressing effected by light irradiation. When optical dressing by light irradiation is performed, it is preferable to operate the waste matter removing device of the present invention simultaneously with the optical dressing.

In FIGS. 13 to 17, optical dressing is performed after configuration correction of a polishing surface by mechanical dressing. In order that a first wafer W and a tenth wafer W, for example, after the configuration correction may be polished under the same conditions, the optical dressing by light irradiation is performed after the configuration correction. The polishing surface may be excessively rough immediately after the configuration correction by the mechanical dressing. Therefore, the optical dressing using light irradiation is performed to generate free abrasive particles softly from the fixed abrasive constituting the polishing surface, thereby allowing polishing of semiconductor wafers with a minimal incidence of scratches.

In FIG. 16, optical dressing by light irradiation is performed continuously both when polishing is performed and when it is not. The optical dressing is capable of dressing a polishing surface softly and hence will not produce waste matter of large particle diameter nor large asperities. Therefore, the optical dressing is effective in preventing generation of scratches on wafers W, but it may be low in terms of a dressing rate (dressing capability). In such a case, optical dressing is performed continuously both when polishing is performed and when it is not, whereby new free abrasive particles can always be generated from a fixed abrasive constituting a polishing surface. It should be noted that the optical dressing shown in FIGS. 16 and 17 need not always be performed but may be performed intermittently.

In a case where the fixed abrasive 146A is disposed on the turntable 146 as shown in the above-described FIG. 12, the optical dressing mechanism 192 for performing optical dressing by light irradiation may be disposed at a position separate from the top ring 144 as a substrate polishing device in such a manner as to extend over the turntable 146 so that dressing can always be performed irrespective of whether polishing is performed or not.

In such a case, however, the turntable 146 has to be rotated in order to perform dressing over an entire surface of the fixed abrasive. In this case, if a rotational speed of the turntable 146 is excessively high, the first chemical liquid or the like for promoting a dressing action induced by light irradiation may be caused to flow off the turntable 146 by centrifugal force. If the first chemical liquid or the like flows out centrifugally, a conditioning effect weakens correspondingly, and it becomes impossible to ensure a required amount of free abrasive particles generated from the fixed abrasive. To avoid such a situation, it is desirable to maintain the turntable 146 rotating at a low speed, i.e. not more than 10 revolutions per minute, for example, when polishing of a substrate is not performed. By doing so, an undesired loss of the first chemical liquid or the like can be suppressed, and a satisfactory conditioning effect can be obtained.

Meanwhile, an upper side of a polishing pad needs to be maintained in a wet state as in a case of general CMP polishing pads. In this regard also, the turntable 146 is preferably kept rotating with a view to efficiently supplying pure water or a chemical liquid for wetting onto an entire pad surface. The fixed abrasive also needs to be maintained in a wet state. Therefore, it is preferable to keep the turntable 146 rotating when a fluid for maintaining a wet state is supplied even during an operation other than continuous polishing.

INDUSTRIAL APPLICABILITY

As has been stated above, a polishing apparatus according to the present invention has a light source and a waste matter removing device. Accordingly, it is possible to apply light rays to a polishing surface of a polishing tool from the light source to weaken a bond force of a binder for bonding together abrasive particles so that the binder becomes unable to retain the abrasive particles, thereby allowing free abrasive particles to be generated from a fixed abrasive. Further, the waste matter removing device forcefully removes waste matter that would impair uniform generation of free abrasive particles from the fixed abrasive, such as waste matter produced by polishing, or waste matter produced by irradiation with light, thereby eliminating factors causing unstable polishing and thus enabling stable supply of abrasive particles during polishing. Therefore, favorable polishing performance can be obtained.

TABLE 1

| Test No. | Chemical liquid supplied | Light irradiation | First substrate [Å/min] | Second substrate [Å/min] | Third substrate [Å/min] |
|---|---|---|---|---|---|
| 1 | Only pure water | Performed | 26 | 3 | 12 |
| 2 | Only pure water | Not performed | 27 | 5 | 3 |
| 3 | Alkali solution (KOH, pH = 10.6) | Performed | 27 | 6 | 18 |
| 4 | Alkali solution (KOH, pH = 10.6) | Not performed | 32 | 6 | 8 |
| 5 | Standard buffer solution (borate pH standard solution) | Performed | 27 | 3 | 94 |
| 6 | Standard buffer solution (borate pH standard solution) | Not performed | 28 | 5 | 21 |

TABLE 2

| Test No. | Chemical liquid supplied | Light irradiation | First substrate [Å/min] | Second substrate [Å/min] | Third substrate [Å/min] |
|---|---|---|---|---|---|
| 1 | Only pure water | Performed | 119.2 | 102.2 | 102.5 |
| 2 | Only pure water | Not performed | 119.2 | 101.8 | 93.7 |
| 3 | Standard buffer solution (borate pH standard solution) | Performed | 126.0 | 100.8 | 117.8 |

What is claimed is:

1. A polishing apparatus comprising:

a polishing tool having a polishing surface including abrasive particles and a binder for bonding together said abrasive particles;

a moving mechanism for pressing a substrate against said polishing surface and causing relative movement between the substrate and said polishing surface so as to polish the substrate;

a light source for irradiating said polishing surface with light rays for weakening a bond force of said binder;

a waste matter removing mechanism for removing waste matter, produced by irradiation of said polishing surface with the light rays, from said polishing surface; and a first-liquid supply device for supplying a first liquid onto said polishing surface;

wherein said waste matter removing mechanism includes a second-liquid supply device for supplying a second liquid onto said polishing surface so as to remove the waste matter from said polishing surface, with the first liquid and the second liquid being different from each other.

2. The polishing apparatus according to claim 1, wherein said waste matter removing mechanism further includes a dresser, including diamond particles, capable of pressing against said polishing surface.

3. The polishing apparatus according to claim 1, wherein said waste matter removing mechanism further includes a brush capable of rubbing against said polishing surface.

4. The polishing apparatus according to claim 1, wherein said waste matter removing mechanism further includes a fluid mixture generator for spraying a fluid mixture of a gas and a liquid toward said polishing surface.

5. The polishing apparatus according to claim 1, wherein said waste matter removing mechanism further includes an ultrasonic wave generator for generating an ultrasonic wave toward said polishing surface.

6. A polishing apparatus comprising:

a polishing tool having a polishing surface including abrasive particles and a binder for bonding together said abrasive particles;

a moving mechanism for pressing a substrate against said polishing surface and causing relative movement between the substrate and said polishing surface so as to polish the substrate;

a light source for irradiating said polishing surface with light rays for weakening a bond force of said binder; and a waste matter removing mechanism for removing waste matter, produced by irradiation of said polishing surface with the light rays, from said polishing surface, wherein said waste matter removing mechanism includes a vacuum suction mechanism for sucking in the waste matter from said polishing surface via a vacuum.

7. A method of dressing a polishing surface of a polishing tool, wherein said polishing surface includes abrasive particles and a binder for bonding together said abrasive particles and is used during a polishing operation in which said polishing surface is pressed against a substrate and moved relative thereto so as to polish the substrate, said method comprising:

irradiating said polishing surface with light rays for weakening a bond force of said binder;

forcefully removing waste matter from said polishing surface;

supplying a first liquid onto said polishing surface while irradiating said polishing surface with said light rays; and supplying a second liquid onto said polishing surface while forcefully removing said waste matter from said polishing surface, wherein said first liquid and said second liquid are different from each other.

8. The method according to claim 7, wherein forcefully removing waste matter from said polishing surface includes pressing against said polishing surface a dresser including diamond particles.

9. The method according to claim 7, wherein forcefully removing waste matter from said polishing surface includes rubbing a brush against said polishing surface.

10. The method according to claim 7, wherein forcefully removing waste matter from said polishing surface includes spraying said polishing surface with a pressure-controlled fluid mixture of a gas and a liquid.

11. The method according to claim 7, wherein forcefully removing waste matter from said polishing surface includes irradiating said polishing surface with an ultrasonic wave.

12. A method of dressing a polishing surface of a polishing tool, wherein said polishing surface includes abrasive particles and a binder for bonding together said abrasive particles and is used during a polishing operation in which said polishing surface is pressed against a substrate and moved relative thereto so as to polish the substrate, said method comprising:

irradiating said polishing surface with light rays for weakening a bond force of said binder; and forcefully removing waste matter from said polishing surface by sucking in said waste matter via a vacuum.

13. A method of dressing a polishing surface of a polishing tool, wherein said polishing surface includes abrasive particles and a binder for bonding together said abrasive particles and is used during a polishing operation in which said polishing surface is pressed against a substrate and moved relative thereto so as to polish the substrate, said method comprising:

during the polishing operation and between one polishing operation and a subsequent polishing operation, irradiating said polishing surface with light rays for weakening a bond force of said binder, wherein when a rate of dressing by irradiating said polishing surface with light rays is high, irradiating said polishing surface with light rays during the polishing operation comprises intermittently irradiating said polishing surface with said light rays during the polishing operation, and wherein when a rate of dressing by irradiating said polishing surface with light rays is low, irradiating said polishing surface with light rays during the polishing operation comprises continually irradiating said polishing surface with said light rays during the polishing operation.

14. The dressing method according to claim 13, wherein the polishing operation is performed by rotating said polishing tool, with a number of revolutions of said polishing tool during a time when the polishing operation is not performed being not more than 10 revolutions per minute.

* * * * *